US007530664B2

(12) United States Patent
Shimazaki et al.

(10) Patent No.: US 7,530,664 B2
(45) Date of Patent: May 12, 2009

(54) MAINTENANCE DEVICE FOR LIQUID-EJECTING APPARATUS AND LIQUID-EJECTING APPARATUS

(75) Inventors: Jun Shimazaki, Shiojiri (JP); Koji Harada, Shiojiri (JP); Seiji Tojo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 440 days.

(21) Appl. No.: 11/535,919

(22) Filed: Sep. 27, 2006

(65) Prior Publication Data

US 2007/0085875 A1 Apr. 19, 2007

(30) Foreign Application Priority Data

Sep. 29, 2005 (JP) ..... 2005-285497
Sep. 29, 2005 (JP) ..... 2005-285498

(51) Int. Cl.
*B41J 2/165* (2006.01)

(52) U.S. Cl. ..... 347/32; 347/22

(58) Field of Classification Search ..... 347/20, 347/32, 33, 22, 23, 30
See application file for complete search history.

(56) References Cited

U.S. PATENT DOCUMENTS 5,138,343 A * 8/1992 Aichi et al. ..... 347/30
6,132,027 A * 10/2000 Suzuki et al. ..... 347/33
6,220,692 B1 * 4/2001 Iwaya et al. ..... 347/33
2002/0003553 A1 * 1/2002 Ng ..... 347/22
2003/0122891 A1 * 7/2003 Hamamoto et al. ..... 347/23

FOREIGN PATENT DOCUMENTS

| | | |
|---|---|---|
| JP | 10-202916 | 8/1998 |
| JP | 2002-001977 | 1/2002 |
| JP | 2003-154686 | 5/2003 |
| JP | 2005-144690 | 6/2005 |

* cited by examiner

*Primary Examiner*—Stephen D Meier
*Assistant Examiner*—Carlos A Martinez, Jr.
(74) *Attorney, Agent, or Firm*—Workman Nydegger

(57) ABSTRACT

A maintenance device installed in a liquid-ejecting apparatus including a movable carriage that has a liquid ejection head performs maintenance of the liquid ejection head and includes at least one maintenance component that reciprocates between an operating position at which the maintenance component engages with the carriage or the liquid ejection head and a standby position at which the maintenance component is disengaged from the carriage and the liquid ejection head; a power transmission mechanism that transmits power input from a rotational drive source to output power for reciprocating the maintenance component between the operating position and the standby position, the power transmission mechanism having a clutch unit on a power transmission path of the power transmission mechanism; and a retaining mechanism including a stopper that moves in association with the movement of the carriage such that the stopper engages with at least one movable body provided on the power transmission path between the maintenance component and clutch surfaces of the clutch unit when the carriage is separated from a cleaning position, and such that the stopper is disengaged from the movable body when the carriage is at the cleaning position.

20 Claims, 9 Drawing Sheets

MAINTENANCE DEVICE FOR LIQUID-EJECTING APPARATUS AND LIQUID-EJECTING APPARATUS

BACKGROUND

1. Technical Field

The present invention relates to maintenance devices for liquid-ejecting apparatuses and the liquid-ejecting apparatuses.

2. Related Art

An inkjet recording apparatus is known as an example of a liquid-ejecting apparatus. The inkjet recording apparatus includes a recording head (liquid ejection head). A printing operation using the recording head is performed by ejecting ink droplets from the recording head while moving the recording head relative to a recording sheet. In order to perform high-quality printing by reliably ejecting the ink droplets from the recording head, it is necessary to perform cleaning of the recording head at a suitable timing during the printing operation or in a period in which the printing operation is not performed so that defects, such as clogging of nozzle holes, can be remedied or prevented. For this purpose, the inkjet recording apparatus generally includes a maintenance device for the recording head.

The maintenance device includes a wiper having a wiping member composed of an elastic material formed into a rectangular shape, a cap that functions as a lid for capping a nozzle surface of the recording head in order to prevent ink in the nozzles from drying, and a suction pump for generating a negative pressure for sucking out the ink through nozzle holes formed in the nozzle surface. In an ink suction operation, the nozzle surface is capped to form a sealed space and the suction pump is driven to generate a negative pressure in the sealed space. Accordingly, the ink is sucked out through the nozzle holes in the recording head, so that ink with increased velocity, bubbles, etc., can be discharged. Normally, a wiping operation using the wiper is performed after the suction operation, so that ink and paper dust adhering to the nozzle surface can be removed and the liquid meniscus in the nozzle holes can be adjusted. In addition, in the period in which the printing operation is not performed, the nozzle surface is covered with the cap to prevent the ink in the nozzles from drying. A maintenance device having a lock lever for restraining a carriage at a cleaning position so that capping can be performed while the recording head is at a predetermined position is known (for example, JP-A-2002-1977). In this maintenance device, the wiper and the lock lever are driven by the same power transmission mechanism.

In the maintenance device, the wiper, the cap, and the suction pump must be operated individually. However, when individual rotational drive sources are provided, a plurality of rotational drive sources and individual power transmission mechanisms are necessary. As a result, the structure of the maintenance device becomes complex and the size of the maintenance device is increased. Accordingly, JP-A-2003-154686, for example, discloses a maintenance device including a wiper, a cap, and a suction pump that are operated by a common rotational drive source. In this maintenance device, the number of rotational drive sources can be reduced to one. However, when the maintenance device is installed into an inkjet recording apparatus, the rotational drive source must be provided in addition to at least one rotational drive source for feeding and ejecting recording sheets and the rotational drive source for reciprocating the carriage on which the recording head is mounted.

Accordingly, JP-A-2005-144690 and JP-A-10-202916, for example, disclose inkjet printers in which a paper feed motor for driving a paper feed roller and a conveying roller functions also as a rotational drive source for driving a wiper, a cap, and a suction pump included in a maintenance device (maintenance mechanism). In these printers, the paper feed motor is rotated forward for driving the paper feed roller or the conveying roller, and is rotated in the reverse direction for operating the wiper, the cap, or the suction pump. The suction pump is driven when the paper feed motor is rotated in the reverse direction, and is set to a released state when the paper feed motor is rotated forward. Therefore, a negative pressure is not generated when a paper sheet is being fed or ejected.

A clutch mechanism is additionally provided to prevent the rotation of the paper feed motor from being transmitted to an automatic sheet feeder when the carriage is at a home position (during cleaning). According to JP-A-2005-144690 and JP-A-10-202916, a cueing operation for positioning the recording sheet at a predetermined position is performed, the cueing operation including a backfeed process in which the paper feed motor is rotated in the reverse direction. Therefore, a transmission-delaying unit is provided which causes a delay in transmission of rotation by one turn between an input and an output thereof, so that the maintenance device can be prevented from being activated during the backfeed process.

However, since it is necessary to provide the transmission-delaying unit, the structure of the maintenance device becomes complex. In addition, although the reverse rotation of the paper feed motor is allowed within the amount of rotation delayed by the transmission-delaying unit, if the electric motor is rotated in the reverse direction by an amount larger than the amount of rotation delayed by the transmission-delaying unit, the wiper or the cap moves upward. Therefore, if the carriage moves to the home position after the paper feed motor is rotated in the reverse direction by an amount larger than the amount of rotation delayed by the transmission-delaying unit in order to convey the paper sheet, there is a risk that the recording head comes into contact with the wiper or the cap that is moved upward. Accordingly, even if there are demands for rotating the paper feed motor in the reverse direction by an amount larger than the amount of rotation delayed by the transmission-delaying unit in order to, for example, convey the recording sheet backward (backfeed) for purposes other than cueing in the paper conveying operation, such a demand cannot be satisfied. Thus, when a rotational drive source is used in common for the paper conveying mechanism and the maintenance device, the above-described problems must be solved to increase freedom in the control of, for example, moving the recording sheet backward by rotating the paper feed motor in the reverse direction without causing interference between the paper conveying system and the cleaning system.

SUMMARY

An advantage of some aspects of the invention is that a maintenance device for a liquid-ejecting apparatus and the liquid-ejecting apparatus can be provided in which maintenance components, such as a lock member and a wiper, can be adequately operated even when, for example, a rotational drive source is used in common for a plurality of devices.

According to a first aspect of the invention, a maintenance device installed in a liquid-ejecting apparatus including a movable carriage that has a liquid ejection head performs maintenance of the liquid ejection head and includes at least one maintenance component that reciprocates between an operating position at which the maintenance component engages with the carriage or the liquid ejection head and a standby position at which the maintenance component is disengaged from the carriage and the liquid ejection head; a power transmission mechanism that transmits power input from a rotational drive source to output power for reciprocating the maintenance component between the operating position and the standby position, the power transmission mechanism having a clutch unit on a power transmission path of the power transmission mechanism; and a retaining mechanism including a stopper that moves in association with the movement of the carriage such that the stopper engages with at least one movable body provided on the power transmission path between the maintenance component and clutch surfaces of the clutch unit when the carriage is separated from a cleaning position, and such that the stopper is disengaged from the movable body when the carriage is at the cleaning position. Here, the maintenance component includes not only a maintenance component in the narrow sense that comes into contact with the liquid ejection head to perform a maintenance operation, such as cleaning, but also a maintenance component that supports the maintenance operation by, for example, adjusting the position and orientation of the liquid ejection head so that the maintenance component in the narrow sense can more easily perform the maintenance operation. This basically applies to the other parts of the description herein unless especially noted otherwise. In addition, the liquid is not limited to ink used for recording (printing), and also includes liquid bodies containing specific functional materials that are used as liquid when an electronic circuit board is manufactured by at least partially using an inkjet method.

According to the above-described structure, when the carriage is not at the cleaning position, the stopper is engaged with the movable body (including the maintenance component) that is positioned downstream of the clutch surfaces of the cultch unit in the power-transmitting direction. In this state, even when the rotational drive source is driven, the power is not transmitted to the maintenance component through the power transmission mechanism and the maintenance component is prevented from moving from the standby position to the operating position. Therefore, even if, for example, the rotational drive source is used in common with another device and the power of the rotational drive source is input to the power transmission mechanism as the rotational drive source is driven to operate that device, the maintenance component is prevented from moving from the standby position to the operating position. When the carriage is at the cleaning position, the stopper is disengaged from the movable body. Accordingly, when the rotational drive source is driven in this state, the power of the rotational drive source is transmitted to the maintenance component through the power transmission mechanism and the maintenance component is moved from the standby position to the operating position. Therefore, the maintenance operation (including the maintenance support process) for the carriage or the liquid ejection head can be performed by the maintenance component. The maintenance operation for the carriage includes a maintenance support process in which the maintenance component engages with the carriage to adjust the position and orientation of the liquid ejection head.

Preferably, the above-described maintenance device includes a cap that seals a nozzle surface of the liquid ejection head, the cap functioning as a maintenance component other than the maintenance component operated by the power transmitted through the power transmission mechanism and a moving unit that reciprocates the cap between a standby position and a sealing position, the moving unit including a slider that engages with the carriage or the liquid ejection heat to slide therewith when the carriage moves to the cleaning position; a guiding unit that guides the slider in a vertical direction when the slider slides; and an urging unit for urging the slider downward. The cap is mounted on the slider. In addition, the restraining member includes the moving unit and the stopper is provided on the slider. The sealing function of the cap includes, for example, at least one of a sealing function of capping the nozzle surface to prevent the liquid in nozzles of the liquid ejection head from drying and a sealing function of capping the nozzle surface to suck out the liquid through nozzle holes formed in the nozzle surface. The sealing function of the cap can be obtained as long as at least a region including the nozzle holes through which the liquid is ejected can be sealed. This also applies to the other parts of the description herein unless especially noted otherwise.

Accordingly, among a plurality of maintenance components, the cap is reciprocated between the standby position and the sealing position by the moving unit that is different from the power transmission mechanism. This moving unit includes the slider that engages with the carriage or the liquid ejection head to slide therewith when the carriage moves to the cleaning position. When the slider slides, the slider is guided by the guiding unit so as to move upward, and thereby moves the cap from the standby position to the sealing position. In addition, when the carriage moves away from the cleaning position, the slider moves downward due to an urging force applied by the urging unit and the cap returns to the standby position from the sealing position. The stopper is provided on the slider and moves in association with the vertical movement of the cap. Since retaining mechanism is structured using the moving unit of the cap, it is not necessary to provide an additional mechanism for moving the stopper in association with the carriage. In other words, the retaining mechanism can be easily structured simply by providing the stopper on the slider included in the moving unit of the cap. As a result, the size of the maintenance device is not largely increased even though the retaining mechanism is additionally provided.

According to a second aspect of the invention, a maintenance device installed in a liquid-ejecting apparatus including a movable carriage that has a liquid ejection head performs maintenance of the liquid ejection head and includes a cap that seals a nozzle surface of the liquid ejection head; a moving unit that reciprocates the cap between the standby position and the sealing position; at least one maintenance component that reciprocates between an operating position at which the maintenance component engages with the carriage or the liquid ejection head and a standby position at which the maintenance component is disengaged from the carriage and the liquid ejection head; a power transmission mechanism that transmits power input from a rotational drive source to output power for reciprocating the maintenance component between the operating position and the standby position, the power transmission mechanism having a clutch unit on a power transmission path of the power transmission mechanism; and a retaining mechanism including a stopper that moves in association with the movement of the cap such that the stopper engages with at least one movable body provided on the power transmission path between the maintenance component and clutch surfaces of the clutch unit when the cap is at the standby position, and such that the stopper is disengaged from the movable body when the cap is at the sealing position.

Accordingly, the cap is moved between the standby position and the sealing position by the moving unit such that the cap is positioned at the sealing position in a maintenance period (during cleaning or capping) and is positioned at the standby position in a period other than the maintenance period. When the cap is not at the sealing position, the stopper is engaged with the movable body (including the maintenance component) that is positioned downstream of the clutch surfaces of the cultch unit in the power-transmitting direction. In this state, even when the rotational drive source is driven, the power is not transmitted to the maintenance component through the power transmission mechanism and the maintenance component is prevented from moving to the operating position. Therefore, even if, for example, the rotational drive source is used in common with another device and the power of the rotational drive source is input to the power transmission mechanism as the rotational drive source is driven to operate that device, the maintenance component is prevented from moving to the operating position. When the cap is at the standby position, the stopper is disengaged from the movable body. Accordingly, when the rotational drive source is driven in this state, the power of the rotational drive source is transmitted to the maintenance component through the power transmission mechanism and the maintenance component is moved to the operating position. Therefore, the maintenance operation (including the maintenance support process) for the carriage or the liquid ejection head can be performed by the maintenance component. The maintenance operation for the carriage includes a maintenance support process in which the maintenance component engages with the carriage to adjust the position and orientation of the liquid ejection head.

In the maintenance device, preferably, the power transmission mechanism includes a cam body having a cam portion that is engageable with a cam follower provided on the maintenance component, and the cam portion and the cam follower are included in a converting unit that converts a movement of the cam body into the reciprocating movement of the maintenance component. In addition, preferably, the movable body with which the stopper engages is the cam body, and the cam body has an engaging portion that engages with the stopper.

Accordingly, the movement of the cam body is converted into the reciprocating movement of the maintenance component by the engagement between the cam portion and the cam follower. When the carriage is not at the cleaning position, the stopper engages with the engaging portion of the cam body so as to restrict the operation of the maintenance component. Since the cam body also functions as the engaging component (movable body) with which the stopper engages, it is not necessary to provide the engaging component in addition to the cam body. Therefore, the number of components of the power transmission mechanism can be reduced and the structure of the power transmission mechanism can be made relatively simple. As a result, for example, the size of the maintenance device can be prevented from being largely increased even though the retaining mechanism is provided.

In the maintenance device, preferably, the clutch unit includes a gear and a rotating body that are coaxially arranged to be rotatable relative to each other and that come into contact with each other and separate from each other at the clutch surfaces, the rotating body being positioned downstream of the clutch surfaces in a power-transmitting direction. In addition, preferably, the movable body with which the stopper engages is the rotating body, and the rotating body has an engaging portion that engages with the stopper.

When the carriage is not at the cleaning position, the stopper engages with the engaging portion of the rotating body included in the clutch unit, so as to restrict the operation of the maintenance component. Since a component of the clutch unit also functions as the engaging component (movable body) with which the stopper engages, it is not necessary to provide the engaging component in addition to the clutch unit. Therefore, the number of components of the power transmission mechanism can be reduced and the structure of the power transmission mechanism can be made relatively simple. As a result, for example, the size of the maintenance device can be prevented from being largely increased even though the retaining mechanism is provided.

In the maintenance device, preferably, the rotating body included in the clutch unit has a cam portion that is engageable with a cam follower provided on the maintenance component, and the cam portion and the cam follower are included in a converting unit that converts a movement of the rotating body into the reciprocating movement of the maintenance component.

In this case, the rotating body included in the clutch unit serves also as the cam body, and it is not necessary to provide the cam body in addition to the clutch unit. Therefore, the number of components of the power transmission mechanism can be further reduced and the structure of the power transmission mechanism can be further simplified.

In the maintenance device, preferably, the at least one maintenance component includes a lock member that engages with the carriage to position the carriage at the cleaning position, the lock member reciprocating between a lock position where the lock member engage with the carriage and a standby position where the lock member is disengaged from the carriage.

Accordingly, the carriage can be positioned at the cleaning position by placing the lock member at the lock position, and the cap can be moved to the sealing position in this state. The nozzle surface of the liquid ejection head can be capped at a suitable position.

In the maintenance device, preferably, the at least one maintenance component includes a wiper that wipes a nozzle surface of the liquid ejection head, the wiper reciprocating between a wiping position and a standby position.

Accordingly, the nozzle surface of the liquid ejection head can be wiped with the wiper by positioning the wiper at the wiping position.

In the maintenance device, preferably, the at least one maintenance component includes a lock member that engages with the carriage to position the carriage at the cleaning position, the lock member reciprocating between a lock position where the lock member engage with the carriage and a standby position where the lock member is disengaged from the carriage. In addition, preferably, the cam body reciprocates within a finite range, and the converting unit covers the movement of the cam body in one direction within the finite range into a singe reciprocation of the lock member in which the lock member moves from the standby position to the lock position and then returns to the standby position.

Accordingly, when the rotational drive source is rotated in one direction for operating the maintenance device, the movement of the cam body in one direction within the finite range is converted into a singe reciprocation of the lock member in which the lock member moves from the standby position to the lock position and then returns to the standby position. Since the lock member quickly moves back to the standby position after locking the carriage, the lock member does not obstruct other maintenance components during the maintenance operations thereof.

In the maintenance device, preferably, the at least one maintenance component includes a wiper that wipes a nozzle surface of the liquid ejection head, the wiper reciprocating between a wiping position and a standby position. In addition, preferably, the cam body reciprocates within a finite range, and the converting unit covers the movement of the cam body in one direction within the finite range into a movement of the wiper from the standby position to the wiping position and converts the movement of the cam body in the other direction within the finite range into a movement of the wiper from the wiping position to the standby position.

Accordingly, when the rotational drive source is rotated in one direction for operating the maintenance device, the movement of the cam body in one direction within the finite range is converted into the movement of the wiper from the standby position to the wiping position. Therefore, the wiper can be retained at the wiping position at which the maintenance operation (wiping) can be performed. In addition, when the rotational drive source is rotated in the other direction, the movement of the cam body in the other direction within the finite range is converted into the movement of the wiper from the wiping position to the standby position. Therefore, the wiper can be returned to the standby position after the wiping operation.

In the maintenance device, preferably, the at least one maintenance component includes a first maintenance component and a second maintenance component that perform different maintenance operations, and the power transmission mechanism includes a cam body having a first cam portion that engages with a first cam follower provided on the first maintenance component and a second cam portion that engages with a second cam follower provided on the second maintenance component, the cam body being positioned downstream of the clutch surfaces in a power-transmitting direction. In addition, preferably, the converting unit includes a first converting member that includes the first cam portion and the first cam follower and converts the movement of the cam body into a reciprocating movement of the first maintenance component, and a second converting member that includes the second cam portion and the second cam follower and converts the movement of the cam body into a reciprocating movement of the second maintenance component.

Accordingly, the movement of a single cam body is converted into the reciprocating movements of the two maintenance components by the first converting unit and the second converting unit. Therefore, the cam body included in the power transmission mechanism for converting the movement thereof into the reciprocating movements of the two maintenance components is used in common by the two maintenance components. Thus, the number of components of the power transmission mechanism can be reduced and the structure of the power transmission mechanism can be made relatively simple. As a result, for example, the size of the maintenance device can be prevented from being increased.

In addition, in the maintenance device, preferably, the cam body reciprocally rotates within a finite range, the first maintenance component moves upward and downward to perform a single reciprocation when the cam body rotates in one direction within the finite range, and the second maintenance component moves upward when the cam body rotates in one direction within the finite range and downward when the cam body rotates in the other direction within the finite range.

Accordingly, when the rotational drive source is rotated in one direction for operating the maintenance device and the cam body rotates in one direction within the finite range, the first maintenance component moves upward and downward to perform a single reciprocation. More specifically, the first maintenance component moves upward to the operating position to perform a certain maintenance operation (first maintenance operation), and then immediately moves downward and returns to the standby position. Accordingly, the first maintenance component is prevented from remaining after the maintenance operation and interfering with the liquid ejection head. In addition, when the cam body rotates in one direction within the finite range, the second maintenance component moves upward and stays at the operating position (maintenance position). Therefore, when the carriage moves afterwards, the second maintenance component can perform a certain maintenance operation (second maintenance operation) for the liquid ejection head at the operating position. At this time, the first maintenance component does not obstruct the second maintenance operation since the first maintenance component is already returned to the standby position. Then, when the rotational drive source is rotated in the other direction so that the cam body also rotates in the other direction, the second maintenance component moves downward and returns to the standby position.

In the maintenance device, preferably, the first maintenance component is a lock member that engages with the carriage to position the carriage at the cleaning position, the lock member reciprocating between a lock position where the lock member engage with the carriage and a standby position where the lock member is disengaged from the carriage, and the second maintenance component is a wiper that wipes a nozzle surface of the liquid ejection head, the wiper reciprocating between a wiping position and a standby position.

Accordingly, when the rotational drive source is rotated in one direction for operating the maintenance device and the cam body rotates in one direction within the finite range, the lock member moves to the lock position so as to position the carriage at the cleaning position and then immediately returns to the standby position. In addition, the wiper moves upward from the standby position to the wiping position and waits at the wiping position. When the carriage is positioned at the cleaning position, the cap moves upward from the standby position to the sealing position so as to seal the nozzle surface at an adequate position. Then, when the carriage moves away from the cleaning position, the nozzle surface is wiped by the wiper that is retained at the wiping position. At this time, the lock member does not obstruct the wiping operation performed by the wiper since the lock member is positioned at the standby position where the lock member is disengaged from the carriage and the liquid ejection head.

Preferably, the maintenance device further includes a suction pump for applying a negative pressure to the cap, the suction pump being driven by power input to the power transmission mechanism.

In such a case, since the suction pump is also driven by the common rotational drive source, when the maintenance device is installed in the liquid-ejecting apparatus, the number of rotational drive sources to be installed in the liquid-ejecting apparatus can be reduced. Therefore, the arrangement space for the rotational drive sources can be reduced and the size of the liquid-ejecting apparatus can be prevented from being increased. In addition, since the number of rotational drive sources is small, the manufacturing cost of the liquid-ejecting apparatus can be reduced.

Preferably, the maintenance device further includes a cap that seals a nozzle surface of the liquid ejection head, the cap functioning as the maintenance component operated by the power transmitted through the power transmission mechanism or as another maintenance component that is operated by a moving unit other than the power transmission mechanism; and a suction pump for applying a negative pressure to the cap, the suction pump being operated by the power input to the power transmission mechanism, the cam body reciprocates within a finite range, and the power input to the suction pump is divided at a position upstream of the clutch surfaces of the clutch unit in a power-transmitting direction in the power transmission mechanism.

In such a case, when the power of the rotational drive source is input to the power transmission mechanism and the cam body is moved in one direction within the finite range so as to move the maintenance component to a predetermined position defined by the converting unit, further movement of the cam body is restricted and the clutch unit is disengaged. Therefore, the rotational drive source can be continuously driven to operate the suction pump even after the maintenance component reaches the predetermined position. Accordingly, the suction pump can be driven for a required time or by a required amount of rotation without being limited by the finite range of the cam body. As a result, the liquid discharge operation for sucking out the liquid from the nozzle holes in the nozzle surface can be adequately performed and the liquid ejection head can be effectively restored.

In the maintenance device, preferably, the clutch unit is a friction clutch unit including a gear, a rotating body arranged coaxially with the gear so as to be rotatable relative to the gear, and a friction clutch that applies a combining frictional force to contact surfaces of the gear and the rotating body, the combining frictional force allowing the gear and the rotating body to rotate together.

In the friction clutch unit, when the gear is rotated by the input power, the rotating body and the gear rotate together so as to transmit the power to the maintenance component when the stopper is not engaged with the rotating body and the load applied to the rotating body is equal to or less than the combining frictional force. When the stopper is engaged with the rotating body and the load applied to the rotating body exceeds the combining frictional force, the friction clutch slips and only the gear rotates relative to the rotating body, so that the power is not transmitted to the maintenance component. The frictional clutch unit that engages and disengages the clutch surfaces depending on the load applied to the rotating body has a simple structure with a small number of components. Therefore, the structure of the power transmission mechanism can be simplified. In the structure in which the cam body reciprocally rotates within the finite range, when the cam body rotates in one direction and reaches an end point, further rotation of the cam body is restricted and a load higher than the combining frictional force is applied to the rotating body. Accordingly, the frictional clutch unit is disengaged and the cam body is prevented from receiving an excessive load even when the rotational drive source is driven continuously. This also applies to the case in which the cam body rotates in the other direction within the finite range.

In the maintenance device, preferably, the rotating body has a tooth portion that meshes with a drive gear that meshes with the gear included in the frictional clutch unit and that is positioned upstream of the gear in the power-transmitting direction, the tooth portion being capable of meshing with the drive gear when the rotating body is in a rotational range corresponding to an intermediate range of a moving stroke of the maintenance component.

In this case, when the rotating body is in the rotational range corresponding to the intermediate range of the moving stroke of the maintenance component, the tooth portion of the rotating body directly meshes with the drive gear that rotates when the power of the rotational drive source is input to the power transmission mechanism. Therefore, the power is directly transmitted from the drive gear to the rotating body, and the maintenance component can be reliably moved within the moving stroke thereof. When the drive gear reaches an end of the tooth portion and is released from the tooth portion, the rotating force of the drive gear is transmitted from the gear to the rotating body through the clutch surfaces in the clutch unit. Then, when the maintenance component reaches an end of the moving stroke (including the reciprocating stroke), a load higher than the combining frictional force is applied to the rotating body and the clutch unit is disengaged so that only the gear rotates and the cam body stops rotating. Accordingly, even when the rotational drive source is continuously driven after the maintenance component reaches an end of the moving stroke, the rotating body and the components (including the maintenance component) positioned downstream of the rotating body are prevented from receiving an excessive load.

According to a third aspect of the invention, a liquid-ejecting apparatus includes a carriage having a liquid ejection head and the above-described maintenance device, the stopper included in the maintenance device operating in association with the movement of the carriage.

According to a fourth aspect of the invention, a liquid-ejecting apparatus includes a liquid ejection head and the above-described maintenance device, the stopper included in the maintenance device operating in association with the movement of the cap.

Preferably, the liquid-ejecting apparatus includes a conveyance drive unit that conveys a medium on which the liquid ejected from the liquid ejection head lands and a rotational drive source that applies power for conveying the medium to the conveyance drive unit, the rotational drive source functioning as a rotational drive source that applies power to the maintenance device. In the liquid-ejecting apparatus, the maintenance device preferably includes a cam body that reciprocates within a finite range. In addition, a first rotating direction of the rotational drive source for driving the conveyance drive unit so as to convey the medium in a liquid ejecting operation is preferably opposite to a second rotating direction of the rotational drive source for driving the maintenance device.

Since the rotational drive source is used in common by the conveyance drive unit and the maintenance device, the number of rotational drive sources can be reduced. Accordingly, for example, the size of the liquid-ejecting apparatus can be reduced. In addition, when the maintenance device includes a cam body that reciprocates within a finite range and a first rotating direction of the rotational drive source for driving the conveyance drive unit is opposite to a second rotating direction for driving the maintenance device, the following effects can be obtained. That is, when the rotational drive source is rotated in the first rotating direction for driving the conveyance drive unit, the cam body is at an end of the finite range so that the maintenance component is at the standby position. Therefore, the maintenance component is prevented from being moved to the operating position when the rotational drive source is driven continuously in the first rotating direction. In addition, when the conveyance drive unit is driven, the carriage is separated from the cleaning position in order to perform the liquid ejecting operation (for example, inkjet printing), and the cap is at the standby position. Therefore, the stopper is engaged with the movable body that is positioned downstream of the clutch surfaces in the power-transmitting direction. Accordingly, even if the rotational drive source is driven in the second rotating direction for, for example, driving the conveyance drive unit in the reverse direction in order to convey the medium backward when cleaning is not performed, the maintenance component is locked due to the engagement of the stopper and is prevented from being moved to the operating position. At this time, unlike the known device, the amount of backward conveyance is not limited to an amount of rotation delayed by a transmission-delaying unit.

In the case in which a suction pump is included, the suction pump is set to a released state when the rotational drive source is driven in the first rotating direction and is driven so as to generate a negative pressure when the rotational drive source is driven in the second rotating direction. Accordingly, the suction pump is set to the released state when the conveyance drive unit is being driven. For example, even when the carriage is moved to the home position, which is the same as the cleaning position, and the cap is moved to the sealing position, the liquid is not discharged from the nozzle holes if the medium is being ejected. When the conveyance drive unit is to be prevented from being driven in the reverse direction if the carriage is disposed at the cleaning position and the suction pump is being driven, a clutch for disconnecting the power transmission path between the rotational drive source and the conveyance drive unit while the carriage is at the cleaning position is preferably provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to FIGS. 1 to 14.

Figure 1:
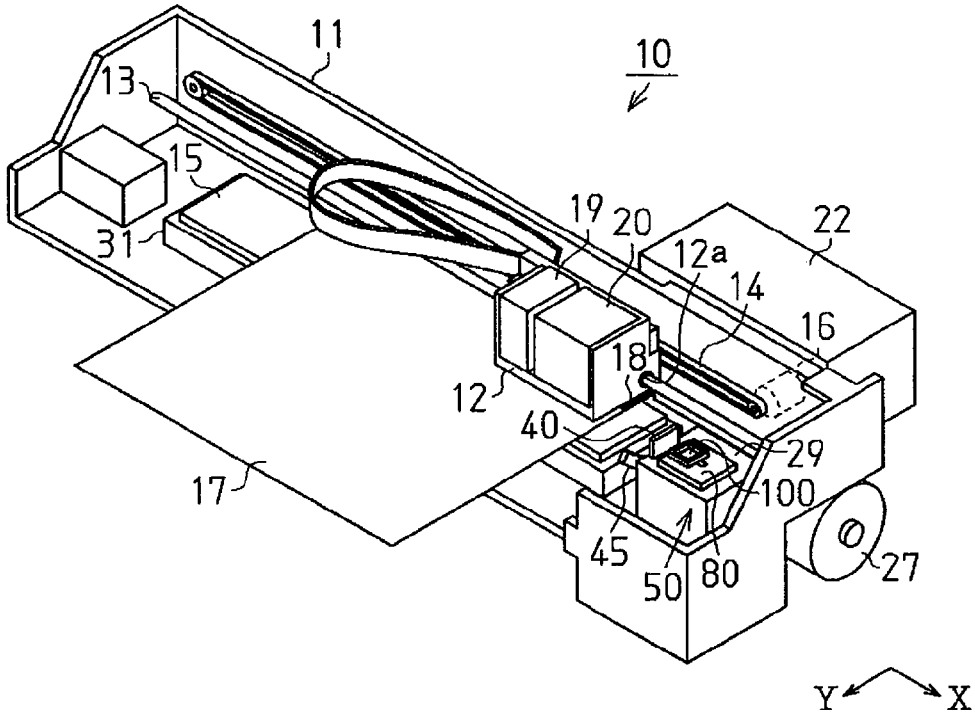
FIG. 1 is a schematic perspective view of a recording apparatus according to an embodiment of the invention.

FIG. 1 is a perspective view showing the basic structure of an inkjet recording apparatus according to the present embodiment. As shown in FIG. 1, the inkjet recording apparatus (hereafter referred to as a recording apparatus 10), which functions as a liquid-ejecting apparatus, includes a base 11 (main frame) and a carriage 12 provided on the base 11 such that the carriage 12 can reciprocate. A guide shaft 13 is fixed at both ends thereof to left and right inner sides of the base 11 in FIG. 1. The carriage 12 has a through hole 12*a* through which the guide shaft 13 extends, and is fixed to a portion of a timing belt 14. When a carriage motor 16 is activated, the timing belt 14 is driven so as to reciprocate the carriage 12 in a main-scanning direction (X-direction in FIG. 1).

An inkjet recording head (hereafter referred to as a recording head 18), which functions as a liquid ejection head, is disposed at the bottom of the carriage 12. The recording head 18 has a nozzle surface 18*a* (see FIGS. 2 and 9) at the bottom, and a plurality of nozzle holes through which ink, which functions as liquid, is ejected are formed in the nozzle surface 18*a*. A platen 15 that defines the distance between the nozzle surface 18*a* of the recording head 18 and the recording sheet 17 is disposed such that the platen 15 faces the recording head 18 in the base 11. In addition, a black ink cartridge 19 for supplying black ink to the recording head 18 and a color ink cartridge 20 which stores yellow ink, cyan ink, and magenta ink individually are disposed in an upper section of the carriage 12 in a detachable manner. Ink is supplied to the recording head 18 from the ink cartridges 19 and 20. The recording head 18 receives ink from the ink cartridges 19 and 20 and ejects (discharges) the ink through the nozzle holes formed in the nozzle surface 18*a*.

A paper feed tray 21 (see FIG. 2) on which a stack of recording sheets 17 can be stored and a paper feed device 22 which picks up the uppermost recording sheet 17 of the stack of recording sheets 17 on the paper feed tray 21 and feeds the recording sheet 17 downstream in a sub-scanning direction Y are disposed behind the recording apparatus 10. In addition, various kinds of rollers 23 to 26 (see FIG. 2) for conveying the recording sheet 17 are rotatably provided in the base 11. Among the rollers 23 to 26, driving rollers 23 and 25 are rotated so as to convey the recording sheet 17 in the sub-scanning direction (Y direction in FIG. 1). In an operation of recording (printing) on the recording sheet 17, a process of ejecting ink toward the recording sheet 17 from the nozzle surface 18*a* of the recording head 18 while reciprocating the carriage 12 in the main-scanning direction X and a process of conveying the recording sheet 17 by a predetermined distance in the sub-scanning direction Y are repeated.

In FIG. 1, the carriage 12 is stationary at a so-called home position (cleaning position). The home position is a position disposed outside a main-scanning range (print area) of the recording operation, and serves as a standby position where the carriage 12 is placed in a recording standby state. In addition, the home position also serves as a start reference position (origin) for recording control. Maintenance operations, such as cleaning, of the recording head 18 are also performed when the carriage 12 is stationary at the home position.

Therefore, a maintenance unit 50 (maintenance device) is disposed at the home position. The maintenance unit 50 includes a substantially rectangular cap 100 that functions as a lid for preventing the nozzle holes in the recording head 18 from drying, a wiper 40 for wiping the nozzle surface 18*a*, a suction pump 29 for applying a negative pressure to the cap 100, and a carriage lock lever (hereafter referred to as a lock lever 45), which functions as a lock member, for retaining the carriage 12 at the cleaning position. When the carriage 12 is moved to the home position and the recording head 18 is positioned directly above the cap 100, the cap 100 can move upward and seal the nozzle surface 18*a*. In the sealing operation, the lock lever 45 is held upright at a lock position and engages with a lower portion of the carriage 12, so that the cap 100 comes into contact with the nozzle surface 18*a* while the carriage 12 is retained at the cleaning position.

In addition to the above-described lid function (capping function) for preventing the nozzle holes from drying, the cap 100 also provides a function as a part of a liquid suction unit. More specifically, the cap 100 forms a sealed space by capping the nozzle surface 18*a* of the recording head 18. Then, a negative pressure is generated in the sealed space by the suction pump 29 so that the ink can be discharged from the recording head 18. The waste liquid, such as ink, that is sucked out in the liquid suction operation (ink suction operation) flows out of the cap 100 through a tube 30 (see FIG. 2) having the suction pump 29 disposed at an intermediate position thereof, and is discharged into a waste liquid tank 31 positioned under the platen 15.

The wiper 40 is positioned adjacent to the cap 100 on the side facing the print area such that the wiper 40 can move in the vertical direction. The wiper 40 moves upward when the liquid suction operation is performed. When the carriage 12 moves from the home position toward the print area after the liquid suction operation, the wiper 40 placed at the upper position (wiping position) slides along the nozzle surface 18*a*, thereby wiping the nozzle surface 18*a*. The maintenance unit 50 according to the present embodiment is driven by power supplied from an electric motor 27 (paper feed motor) (see FIG. 2) that functions as a rotational drive source for driving the rollers 23, 25, and 32 (see FIG. 2) for feeding, conveying, and ejecting the recording sheet 17. In the present embodiment, the maintenance unit 50 includes the lock lever 45, the wiper 40, and the cap 100 as maintenance components. Among these three components, the lock lever 45 (first maintenance component) and the wiper 40 (second maintenance component) are driven by the power supplied from the electric motor 27 that functions as the rotational drive source.

Figure 2:
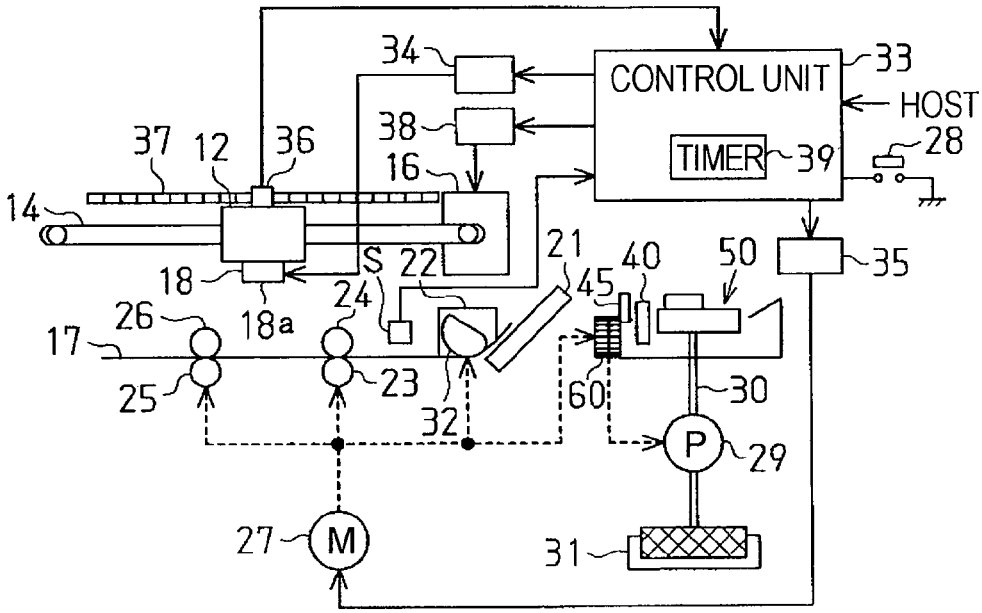
FIG. 2 is a block diagram illustrating the electrical structure of the recording apparatus.

FIG. 2 illustrates the electrical structure of the recording apparatus. In FIG. 2, the carriage 12, the carriage motor 16, the electric motor 27 (paper feed motor), the suction pump 29, the waste liquid tank 31, the wiper 40, the lock lever 45, and the cap 100, which are explained above, are denoted by the same reference numerals as those in FIG. 1. In the following description, additional explanations regarding the structures of driving devices for a paper feed system, a paper conveying system, and a paper ejecting system will be provided below. In the schematic diagram of FIG. 2, the direction in which the structure of a carriage-driving system is viewed and the direction in which the paper feed system, the paper conveying system, and the paper ejecting system are viewed differ from each other by 90° for convenience of explanation.

The paper feed device 22 has a paper feed roller 32 positioned downstream of the paper feed tray 21 in the sub-scanning direction Y. The recording sheets 17 stacked on the paper feed tray 21 are pressed against the paper feed roller 32, which is composed of a friction roller that is substantially D-shaped in a side view, by a hopper (not shown) provided on the paper feed tray 21. Only the uppermost recording sheet 17 is separated and fed due to frictional resistance applied when the paper feed roller 32 rotated in the paper feeding direction. The paper feed roller 32 is driven by the electric motor 27. A mechanically operated clutch (not shown) is disposed between the electric motor 27 and the paper feed roller 32, the clutch being disengaged when the carriage 12 is moved to the cleaning position. Accordingly, the power of the electric motor 27 is not transmitted to the paper feed roller 32 while the maintenance unit 50 is operated.

The recording apparatus 10 includes a driving roller 23 and a plurality of driven rollers 24 for intermittently conveying the recording sheet 17 in the sub-scanning direction Y. The driving roller 23 is rotated by the electric motor 27. The recording sheet 17 is conveyed in the sub-scanning direction Y due to the rotation of the driving roller 23. The driven rollers 24 are individually urged against the driving roller 23. When the recording sheet 17 is conveyed due to the rotation of the driving roller 23, the driven rollers 24 are rotated in association with the conveyance of the recording sheet 17 while being in contact with the recording sheet 17.

The recording apparatus 10 further includes a driving roller 25 and a plurality of driven rollers 26 for ejecting the recording sheet 17 after the recording operation. The driving roller 25 is rotated by the electric motor 27. After the recording operation, the recording sheet 17 is ejected in the sub-scanning direction Y due to the rotation of the driving roller 25. Each of the driven rollers 26 has a plurality of teeth on the periphery thereof, each tooth having a pointed tip that comes into point contact with a recording surface of the recording sheet 17. The driven rollers 26 are individually urged against the driving roller 25 by a force smaller than the force by which the driven rollers 24 are urged. When the recording sheet 17 is ejected due to the rotation of the driving roller 25, the driven rollers 26 are rotated in association with the ejection of the recording sheet 17 while being in contact with the recording sheet 17. Thus, after the recording operation, the recording sheet 17 is ejected downstream in the sub-scanning direction Y by the driving roller 25 and the driven rollers 26. An output tray (not shown) to which the recording sheet 17 is ejected after the recording operation is positioned downstream of the driving roller 25 and the driven rollers 26.

The power of the electric motor 27 is also input to a power transmission mechanism 60 included in the maintenance unit 50 and is used for operating the suction pump 29, the wiper 40, and the lock lever 45. Thus, in the recording apparatus 10, a single electric motor 27 functions as a common drive source for the paper feed device 22, a paper conveying device, and a paper ejecting device which are driving devices of the paper feed system, the paper conveying system, and the paper ejecting system, respectively, and driving devices of the cleaning (maintenance) system including the wiping device, the carriage lock device, and the suction pump 29. The electric motor 27 is structured such that a rotating direction for conveying the recording sheet 17 in the sub-scanning direction Y (forward direction) is opposite to a rotating direction for operating the maintenance unit 50 (reverse direction).

A control unit 33 is connected to an input system including a cleaning switch 28 disposed on, for example, an operation panel (not shown), a paper detection sensor S for detecting the leading edge of the recording sheet 17 being fed, and an encoder 36 that outputs a detection signal (pulse signal) corresponding to the position of the carriage 12. In addition, the control unit 33 is connected to an output system including a head-driving circuit 34 and motor-driving circuits 35 and 38. The control unit 33 drives the recording head 18, the carriage motor 16, and the electric motor (paper feed motor) 27 individually by outputting drive signals to the driving circuits.

The control unit 33 generates bitmap data based on print data transmitted from a host computer (not shown), generates a drive signal based on the bitmap data, and transmits the drive signal to the head-driving circuit 34, thereby causing the recording head 18 to eject ink droplets. The recording head 18 has a piezoelectric element (not shown) for each of the nozzles. When a drive voltage (pulse voltage) output from the head-driving circuit 34 on the basis of the drive signal is applied to the piezoelectric elements, the piezoelectric elements expand and contract due to the electrostrictive effect thereof, thereby causing partitioned chambers (ink chambers) that communicate with the nozzles to expand and contract. Accordingly, ink droplets are ejected (discharged) through the nozzle holes.

The encoder 36 has a function of, for example, optically detecting the position of the carriage 12. Accordingly, a slit tape 37 having a plurality of optical slits is arranged along the trajectory of the carriage 12. The encoder (linear encoder) 36 including the slit tape 37 outputs a detection signal (pulse signal) as the carriage 12 moves, the number of pulses of the detection signal corresponding to the number of intermittent passages of light through the slits. The control unit 33 determines the direction in which the carriage 12 is moved on the basis of two kinds of pulse signals with different phases (phase A and phase B) included in the detection signal from the encoder 36. Then, the control unit 33 determines the position of the carriage 12 with respect to the origin (e.g., the home position) by, for example, incrementing the number of pulses corresponding to the number of intermittent passages of light when the carriage 12 is moving in one direction and decrementing the number of pulses when the carriage 12 is moving in the other direction using a counter (not shown) included in the control unit 33.

The control unit 33 controls the carriage motor 16 by outputting a drive signal corresponding to the position of the carriage 12 to the motor-driving circuit 38, and thereby controls the velocity and the moving direction of the carriage 12. In addition, the control unit 33 generates an ejection timing signal that defines the time at which the ink droplets are to be ejected from the recording head 18 on the basis of the detection signal (pulse signal) obtained from the encoder 36, and transmits the generated signal to the head-driving circuit 34 as one of the control signals. Thus, the control unit 33 controls the timing at which the ink droplets are ejected from the recording head 18.

In addition, the control unit 33 has a timer 39 for measuring time periods. The timer 39 has a function of measuring time periods that are set individually for different kinds of cleaning operations (flushing, suction, etc.), and notifies the control unit 33 when the set time periods elapse after the reset. One of the set time periods is a time cycle at which flushing is performed during the printing operation (for example, 10 seconds). When the control unit 33 is notified by the timer 39 that the set time period has elapsed, the control unit 33 moves the carriage 12 to a flushing position outside the print area and carries out flushing. Another one of the set time periods is a time cycle at which the ink suction operation is performed (for example, several hours to several days). When the time that elapsed after the last time the ink suction operation was performed exceeds this time period, the control unit 33 carries out the ink suction operation immediately or when the power is turned on the next time. The control unit 33 also carries out the ink suction operation when the cleaning switch 28 is turned on and an ON signal is input.

When the ink suction operation is carried out (that is, when the maintenance unit 50 is operated), the control unit 33 transmits a reverse rotation signal to the motor-driving circuit 35 so that the electric motor 27 rotates in the reverse direction. The power obtained when the electric motor 27 is rotated in the reverse direction is transmitted to the suction pump 29 via the power transmission mechanism 60, and the suction pump 29 is driven by being rotated in a predetermined direction. Accordingly, a negative pressure is generated in an inner space of the cap 100 (the space surrounded by the cap 100 and the nozzle surface 18*a*) and the ink is sucked out from the nozzle holes formed in the recording head 18. After the suction discharge operation (suction operation), the suction pump 29 is driven again while the cap 100 is separated from the nozzle surface 18*a*, so that the waste ink ejected into the cap 100 is discharged to the waste liquid tank 31. The power obtained when the electric motor 27 is rotated in the reverse direction is also transmitted to the wiper 40 via the power transmission mechanism 60, so that the wiper 40 is moved upward from a standby position to a wiping position before or after the ink suction operation. The detailed structure of the maintenance unit 50 including the suction pump 29 and the wiper 40 will be described below.

After the electric motor 27 is rotated in the reverse direction by a predetermined amount and the ink suction operation is finished, the control unit 33 outputs a drive signal to the motor-driving circuit 38 and causes the carriage 12 to move into the print area from the home position. While the carriage 12 is being moved, the wiper 40 positioned at the wiping position slides along the nozzle surface 18*a* and thereby wipes the nozzle surface 18*a*.

When the paper feed operation, the paper conveying operation, or the paper ejecting operation is performed, the control unit 33 transmits a forward rotation signal to the motor-driving circuit 35 so that the electric motor 27 rotates forward. However, in the recording apparatus 10 according to the present embodiment, a control operation of conveying the recording sheet 17 in a direction opposite to the sub-scanning direction (−Y) (reverse conveyance control) is also performed. When the reverse conveyance control is performed, the control unit 33 transmits a reverse rotation signal to the motor-driving circuit 35 so that the electric motor 27 rotates in the reverse direction. The recording sheet 17 is conveyed in the reverse direction when, for example, cueing of the recording sheet 17 is performed. In the cueing operation, when the leading edge of the recording sheet 17 being fed is detected by the sensor S, the recording sheet 17 is once moved downstream beyond the cueing position of the recording sheet 17 by a predetermined amount and is then moved backward by a predetermined amount to place the recording sheet 17 at the cueing position. The backward conveyance (backfeed) of the recording sheet 17 in the cueing operation is performed to eliminate skewing of the recording sheet 17 and to remove wrinkles from the recording sheet 17.

Structure of Maintenance Unit

Figure 3:
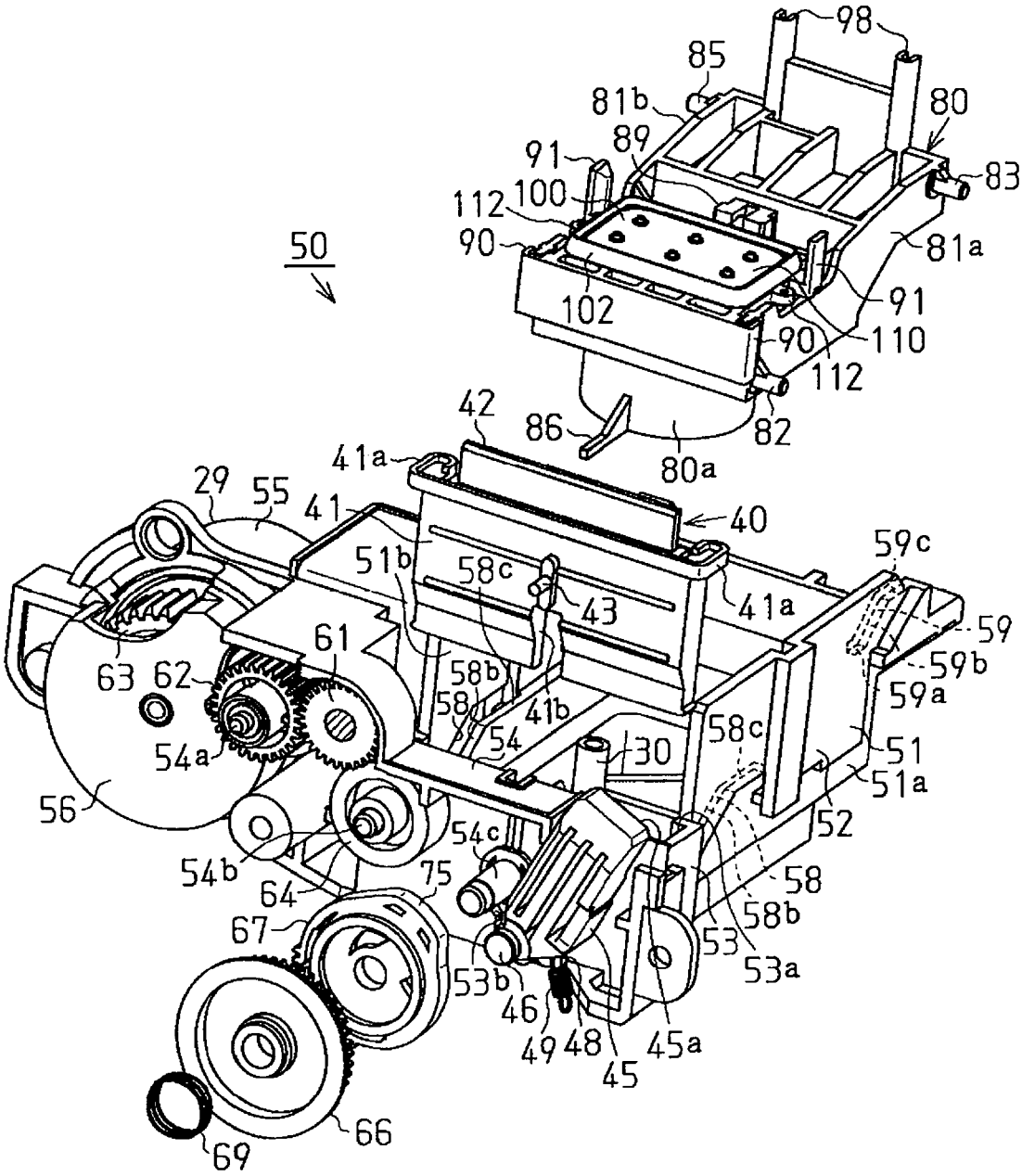
FIG. 3 is an exploded perspective view of a maintenance unit.
Figure 4:
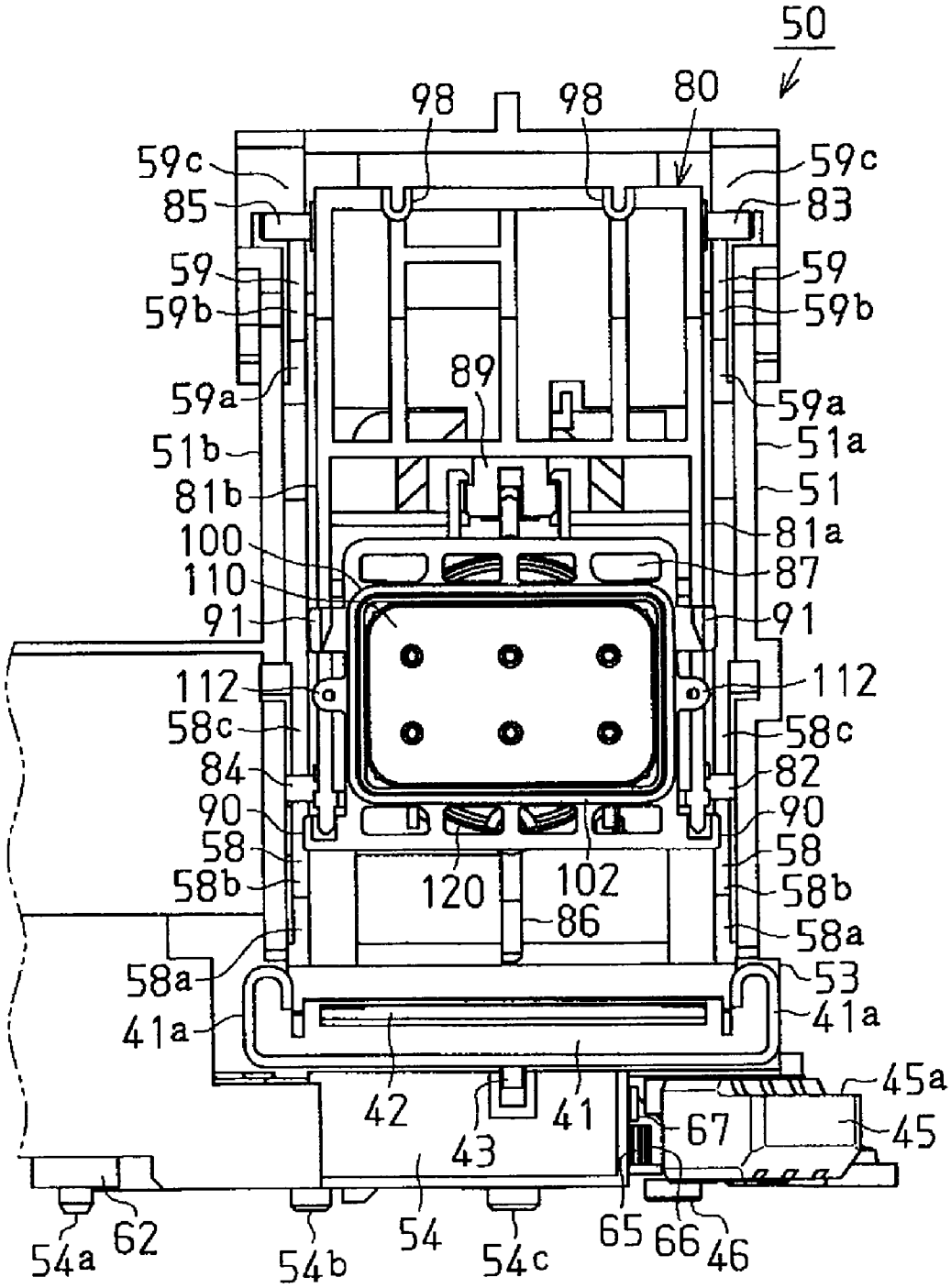
FIG. 4 is a partial plan view of the maintenance unit.
Figure 5:
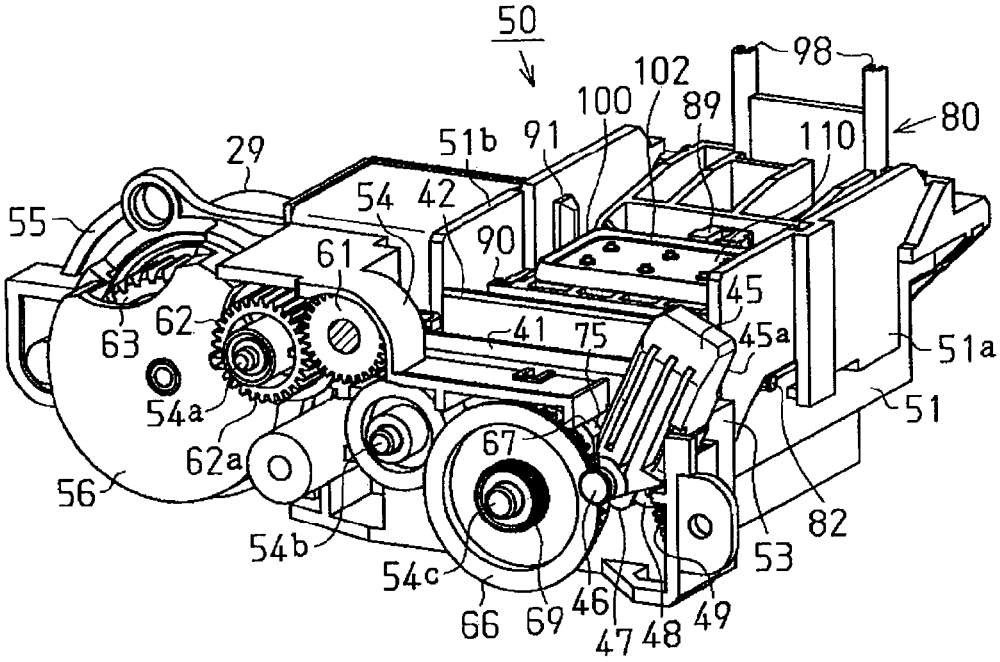
FIG. 5 is a perspective view of the maintenance unit.
Figure 6:
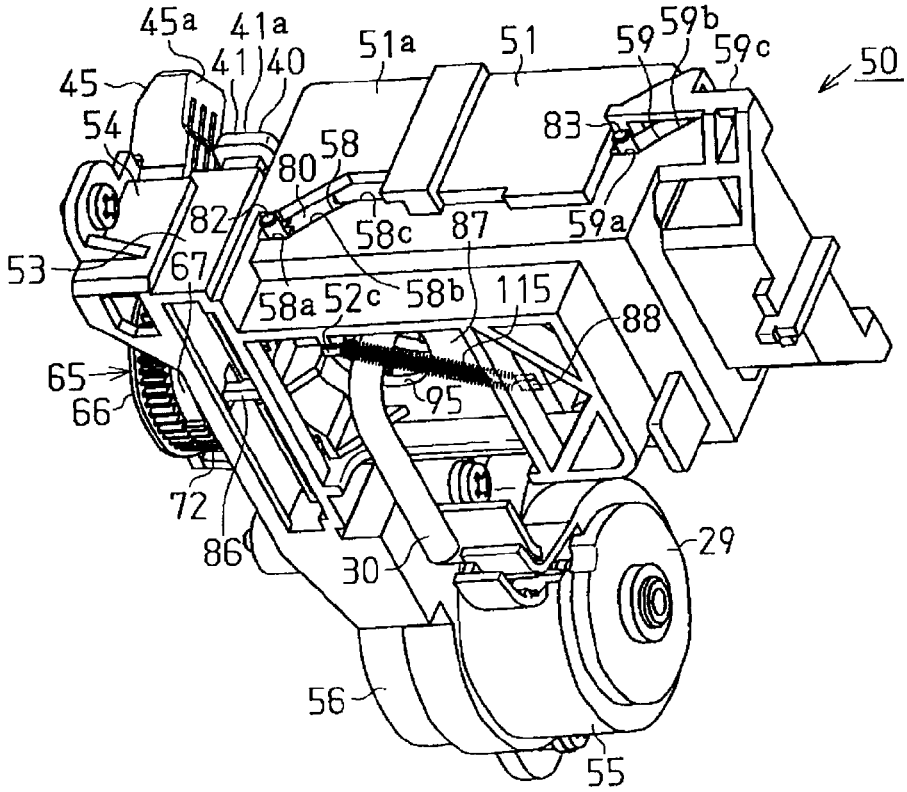
FIG. 6 is a bottom perspective view of the maintenance unit.
Figure 7:
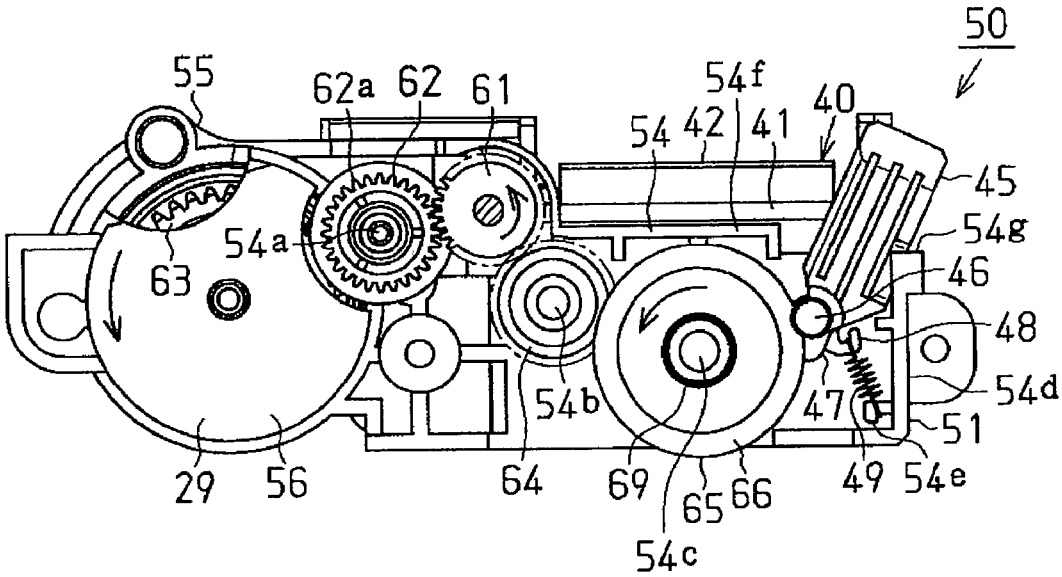
FIG. 7 is a back view of the maintenance unit.

Next, the structure of the maintenance unit 50 included in the recording apparatus 10 will be described below with reference to FIGS. 3 to 7. FIGS. 3 to 7 illustrate the maintenance unit 50, where FIG. 3 is an exploded perspective view, FIG. 4 is a plain view of the main portion, FIG. 5 is a top perspective view, FIG. 6 is a rear perspective view, and FIG. 7 is a rear view. In the following description, the moving direction of the carriage (X direction) is defined as the front-back direction, the front being the direction in which the carriage 12 approaches the home position (upward in FIG. 4). In addition, the sub-scanning direction (Y direction) is defined as the left-right direction.

One of the characteristics of the maintenance unit 50 according to the present embodiment is that when the electric motor 27 is rotated in the reverse direction for purposes other than maintenance operations (for example, for backward conveyance (backfeed)), power is prevented from being transmitted to the wiper 40 and the lock lever 45 at an intermediate position of a power transmission passage by causing a retaining unit (a stopper 86 which will be described below) to engage with a portion of the power transmission mechanism 60. The retaining unit is disengaged in a maintenance period in which the carriage 12 is at the cleaning position. In the present embodiment, an elevator mechanism for the cap 100 uses a slider-driving method in which a slider that carries the cap 10 becomes engaged with the carriage 12 before the carriage 12 reaches the cleaning position and thereby slides in a direction including a vertical component, so that the cap 100 can move vertically. Therefore, the retaining unit operates in association with the vertical movement of the cap 100.

As shown in FIGS. 3 to 7, the maintenance unit 50 includes a housing frame (hereafter referred to as a frame 51), which functions as a base member. The frame 51 is fixed to the base 11 with screws at a position corresponding to the home position near inner side of the base 11 at one end thereof.

The frame 51 includes a guide frame 52 having a box shape with open top and bottom, a guide portion 53 disposed on the back side of the frame portion 52, a gear housing 54 positioned adjacent to the back side and the bottom side (left side in FIG. 3) of the guide portion 53, and a pump casing 55 positioned adjacent to the bottom side of the gear housing 54. The box-shaped guide frame 52 accommodates a slider 80 such that the slider 80 can slide along a guide passage that obliquely extends in a direction having a front-back direction component and a vertical direction component. The guide portion 53 guides the wiper 40 such that the wiper 40 can move vertically. A support plate (not shown) is fixed to the gear housing 54 with small screws so as to cover the back side of the gear housing 54 and accordingly a gear chamber for accommodating the power transmission mechanism 60 is formed. The pump casing 55 has a cylindrical shape with a bottom, and a cover 56 is attached so as to cover an open side at the back, thereby forming a space for accommodating the suction pump 29.

First, the schematic structure of the maintenance unit 50 will be described. The frame 51 supports the wiper 40 that is guided by the guide portion 53 such that the wiper 40 can move vertically. The wiper 40 includes a wiper holder 41 and a wiping member 42 (wiper blade) supported by the wiper holder 41. A guide pin 43 projects from the back surface of the wiper holder 41 at a central position thereof. When the wiper 40 is assembled to the guide portion 53, the guide pin 43 engages with a cylindrical cam 67 which function as a movable body, a rotating body, and a cam body included in the power transmission mechanism 60. Thus, the guide pin 43 functions as a cam follower that is guided in the vertical direction as the cylindrical cam 67 rotates in the forward and reverse directions. Accordingly, the guide pin 43 moves vertically as the cylindrical cam 67 reciprocally rotates, thereby moving the wiper 40 in the vertical direction. The cylindrical cam 67 will be described in detail below together with other structures of the power transmission mechanism 60.

Figure 9:
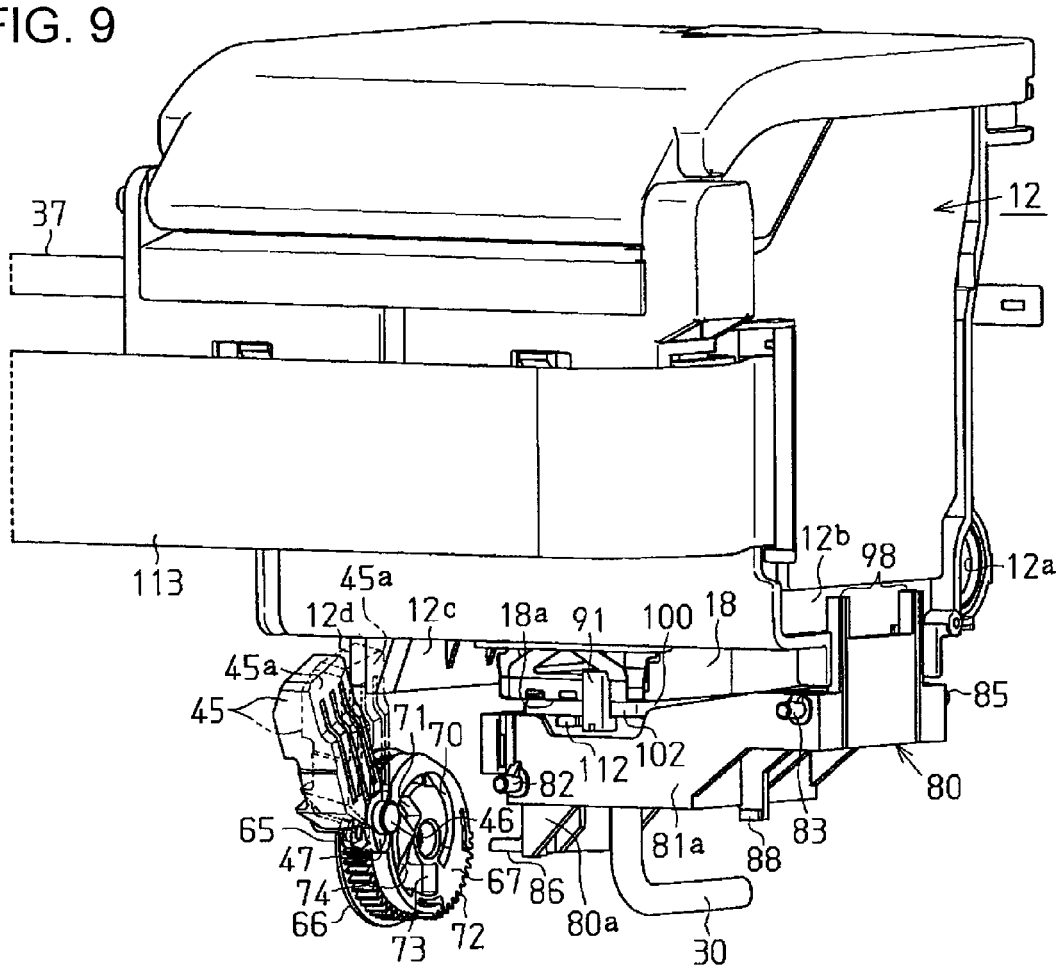
FIG. 9 is a perspective view illustrating the state in which the carriage is disposed at the cleaning position.
Figure 10:
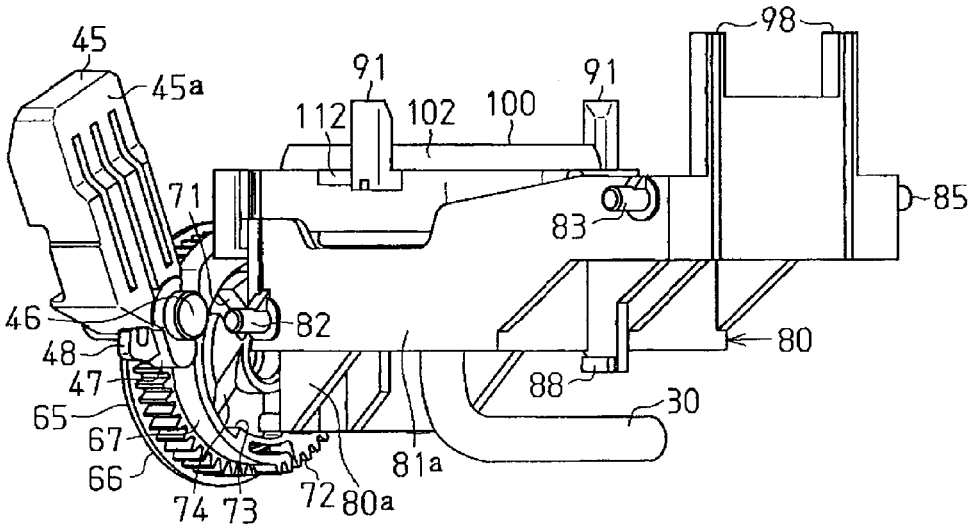
FIG. 10 is a perspective view of the main part of the maintenance unit.

The slider 80, on which the cap 100 is mounted, is supported by the guide frame 52 such that the slider 80 can slide in the front-back direction (vertical direction in FIG. 4). In the supported state, the slider 80 is guided along an oblique passage such that the slider 80 moves upward when the slider 80 slides from the back to the front (upward in FIG. 4) and moves downward when the slider 80 slides from the front to the back (downward in FIG. 4). The slider 80 has a pair of projections 98 that project upward from the front edge thereof (the upper right edge in FIG. 4). Referring to FIG. 9, when the carriage 12 moves to the home position, the carriage 12 comes into contact with the projections 98 and pushes the slider 80, so that the slider 80 moves upward. As shown in FIG. 9, a flexible cable 113 is connected to the carriage 12 at one end thereof. The flexible cable 113 is used for supplying drive signals and drive power to the recording head 18 and for updating or reading history information stored in memories of ICs included in the ink cartridges 19 and 20.

The slider 80 is urged downward and rearward by a coil spring 115 (tension spring) shown in FIG. 6. Accordingly, when the carriage 12 leaves the home position and moves toward the print area, the slider 80 moves downward while sliding rearward due to the urging force applied by the coil spring 115. The slider 80 has a semi-cylindrical protruding portion 80*a* that protrudes downward at the back end of the slider 80. A stopper 86, which functions as a retaining unit, projects vertically (rearward) from the back surface of the protruding portion 80*a*. When the slider 80 is moved downward and the cap 100 is at the lower position (standby position), the stopper 86 engages with the cylindrical cam 67 in the power transmission mechanism 60 and retains the cylindrical cam 67 so that the wiper 40 and the lock lever 45 cannot be moved upward while the cap 100 is at the lower position. The retaining mechanism including the stopper 86 for preventing the upward movement of the wiper 40 and the lock lever 45 will be described below.

Next, the structure of each component in the maintenance unit 50 will be described in detail. First, the power transmission mechanism 60 for transmitting the power input from the electric motor 27 to the suction pump 29 and the wiper 40 will be described.

Power Transmission Mechanism

The power transmission mechanism 60 is accommodated in a gear chamber formed by attaching a support plate (not shown) to the gear housing 54 at one side thereof with small screws. The power transmission mechanism 60 is a gear mechanism having a plurality of gears including an input gear 61, a two-stage gear 62 that meshes with the input gear 61 at a certain position, a gear 64 that meshes with the input gear 61 at another position, and a friction clutch gear mechanism 65 that meshes with the gear 64. The two-stage gear 62, the gear 64, and the friction clutch gear mechanism 65 are rotatably supported by shafts 54*a*, 54*b*, and 54*c*, respectively, that vertically project from the inner wall of the gear housing 54.

Among the components of the power transmission mechanism 60, the input gear 61 receives the power from the electric motor 27 first. The gear 61 includes a pinion gear attached to an output shaft of the electric motor 27 at an end of the output shaft or a gear that is operably connected to the pinion gear.

The two-stage gear 62 includes a first gear portion 62*a* having a small tooth pitch and a second gear portion (not shown) having a large tooth pitch. The input gear 61 meshes with the first gear portion 62*a* and the second gear portion 62*b* meshes with a pump gear 63 that is operably connected to a driving shaft of the suction pump 29. The number of teeth on the pump gear 63 is several times (for example, twice or three times) larger than that of the second gear portion, and the rotation of the gear 61 is reduced in speed when it is transmitted to the pump gear 63 via the two-stage gear 62.

The input gear 61 also meshes with the gear 64 at a position different from the position at which the input gear 61 meshes with the two-stage gear 62. Accordingly, the power transmission path is branched into a first power transmission path that leads to the suction pump 29 via the two-stage gear 62 and a second power transmission path that leads to the wiper 40 via the gear 64.

The friction clutch gear mechanism 65 that is rotatably supported by the shaft 54*c* is disposed adjacent to the gear 64 (see FIGS. 5 and 7). As shown in FIG. 3, the friction clutch gear mechanism 65 includes a cylindrical gear 66, the cylindrical cam 67, and a coil spring 69 (compression spring). The coil spring 69 is assembled in a compressed state between a surface of the cylindrical gear 66 and the support plate. Accordingly, the cylindrical gear 66 and the cylindrical cam 67 are assembled such that the cylindrical gear 66 is urged against the cylindrical cam 67 in the axial direction and contact surfaces (clutch surfaces) of the cylindrical gear 66 and the cylindrical cam 67 are pressed against each other by a predetermined force so as to form a frictionally engaged state. The gear 64 meshes with the cylindrical gear 66. Accordingly, when the cylindrical gear 66 is rotated by the power transmitted from the gear 64, the cylindrical cam 67 that is frictionally engaged with the cylindrical gear 66 rotates together with the cylindrical gear 66. The cylindrical cam 67 has an arc-shaped cam groove 70 (see FIG. 8) that engages with the guide pin 43 on the wiper 40. Accordingly, rotation of the cylindrical cam 67 is converted into vertical movement of the wiper 40 due to the engagement between the cam groove 70 and the guide pin 43, which functions as a cam follower.

Suction Pump

Next, the operation and structure of the suction pump 29 will be described below. In the following description, with regard to each gear included in the power transmission mechanism 60, the direction in which the gear is rotated when the electric motor 27 is rotated in the reverse direction is defined as a forward direction.

When the electric motor 27 is rotated in the reverse direction and the gear 61 is rotated forward in the direction shown by the arrow in FIG. 7, the pump gear 63 is rotated forward in the direction shown by the arrow, so that the suction pump 29 rotates to perform a pumping operation. When the electric motor 27 is rotated forward, the pump gear 63 is rotated in the reverse direction, i.e., in the direction opposite to the direction shown by the arrow and the suction pump 29 is set to a released state.

The suction pump 29 is a tube pump in which a tube 30 is contained in a wound state (in FIG. 6, the tube 30 is drawn as if it is cut at a position immediately before the suction pump 29). A delaying member (not shown) which delays the rotation start time of the driving shaft (rotating shat) of the suction pump 29 with respect to the rotation start time of the pump gear 63 is rotatably supported by the driving shaft. The delaying member is disposed between the pump gear 63 and the driving shaft, and transmits the rotation of the pump gear 63 to the driving shaft of the suction pump 29 at a time delayed by a predetermined period. More specifically, the driving shaft of the suction pump 29 starts to rotate after the pump gear 63 rotates by a predetermined angle (for example, an angel in the range of 100° or more and leas than 360°.

The suction pump 29 includes a rotor that rotates together with the driving shaft, rollers that are rotatably disposed along the outer periphery of the rotor, and the tube 30 that is wound around the rotor one or more turns and that has both ends extended out from the suction pump 29. The rollers are urged outward in the radial direction of the rotor by springs (not shown), and are guided by guide holes such that the rollers are moved outward in the radial direction when the rotor rotates forward and are moved inward in the radial direction against the urging force applied by the springs when the roller rotates in the reverse direction.

When the electric motor 27 is rotated in the reverse direction and the pump gear 63 is rotated forward, the tube 30 included in the suction pump 29 is gradually compressed by the rollers and air, ink, etc., contained in the tube 30 are pushed out, so that a negative pressure is generated in the tube 30 in an area positioned upstream of the suction pump 29. When the electric motor 27 is rotated forward and the pump gear 63 is rotated in the reverse direction, the rollers move inward in the radial direction of the rotor and the released state is established in which the tube 30 is not compressed. Therefore, the negative pressure is not generated.

Carriage Lock Device

Next, the structure of a carriage lock device for operating the lock lever 45 will be described. The carriage lock device includes the electric motor 27, a portion of the power transmission mechanism 60 that forms the power transmission path leading to the lock lever 45 (portion including the friction clutch gear mechanism 65), and the lock lever 45.

As shown in FIGS. 5 and 7, a rectangular prism-shaped lock lever 45 is rotatably attached to the gear housing 54 at a position adjacent to the friction clutch gear mechanism 65. The lock lever 45 is provided for locking (retaining) the carriage 12 at the home position. A pair of rods 46 (only one is shown in FIGS. 5 and 7) are provided so as to project from the front and back sides (sides in the direction perpendicular to the page in FIG. 7) of the lock lever 45 such that the axial lines thereof coincide with each other. The rods 46 are respectively inserted through and supported by a through hole formed in an inner wall surface of the gear housing 54 and a through hole formed in the support plate (neither of the through holes is shown). Accordingly, the lock lever 45 is supported such that the lock lever 45 can rotate about the rods 46.

Figure 11A:
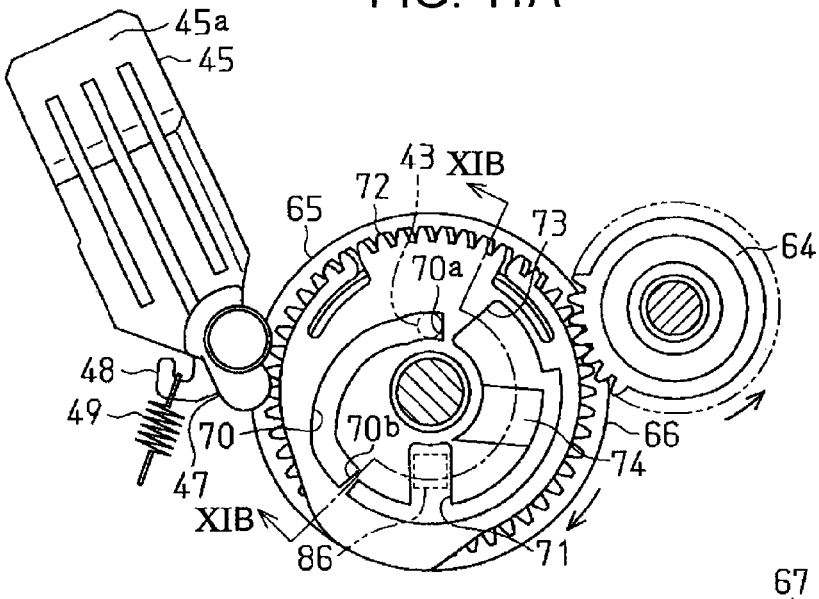
FIG. 11A is a front view of a section around the friction clutch gear mechanism illustrating the operation of the friction clutch gear mechanism when a lock lever pivots and a wiper moves vertically.

As shown in FIGS. 5 and 11A, the front surface of the lock lever 45 functions as a restricting surface 45*a* that engages with the carriage 12. In addition, the lock lever 45 has a projection 47 at a position opposite to the restricting surface 45*a* across the rods 46, the projection 47 projecting in a direction away from the restricting surface 45*a*. The lock lever 45 also has a spring-receiving portion 48 that extends from a position adjacent to the projection 47 in an oblique direction that intersects the axial line. The projection 47 functions as a cam follower that engages with a protrusion 75 (cam) of the cylindrical cam 67 included in the friction clutch gear mechanism 65. An outer peripheral surface (engaging surface) of an end portion of the projection 47 that engages with the protrusion 75 has an arc shape.

A coil spring 49 (tension spring) is stretched between the spring-receiving portion 48 and a spring-receiving portion 54*e* (see FIG. 7) that projects inward from a side wall 54*d* of the gear housing 54 at the bottom of the side wall 54*d*. Accordingly, the lock lever 45 is urged clockwise in FIG. 7 by a tensile force applied by the coil spring 49 while a head portion of the lock lever 45 projects out from an opening (gap) between the side wall 54*d* and a top wall 54*f* of the gear housing 54. Therefore, when the projection 47 is not engaged with the protrusion 75, the position of the lock lever 45 is restricted by a top edge portion 54*g* (see FIG. 7) of the side wall 54*d* of the gear housing 54 and the lock lever 45 is retained at a standby position (unlock position) at which the lock lever 45 is tilted as shown in FIG. 7. When the protrusion 75 of the cylindrical cam 67 and the projection 47 are engaged with each other, the lock lever 45 is pivoted counterclockwise against the urging force of the coil spring 49 and is retained at a lock position at which the lock lever 45 stands upright. The protrusion 75 (cam portion) and the projection 47 (cam follower) form a first converting unit that converts the rotation of the cylindrical cam 67 into a single reciprocation of the lock lever 45 between the standby position and the lock position.

As shown in FIG. 9, a restricting plate 12*c* projects downward from the bottom surface of the carriage 12 at a position behind the recording head 18 (on the left in FIG. 9). The restricting plate 12*c* is disposed at a position such that the restricting plate 12*c* faces the restricting surface 45*a* of the lock lever 45 with a small gap therebetween when the carriage 12 is at the home position shown in FIG. 9 and the lock lever 45 is at the lock position. Accordingly, when the lock lever 45 is at the lock position, the carriage 12 is retained at the home position.

Wiping Device

Next, the structure of the wiping device for operating the wiper 40 will be described. The wiping device includes the electric motor 27, a portion of the power transmission mechanism 60 that forms the power transmission path leading to the wiper 40, and the wiper 40.

As shown in FIG. 3, the wiper 40 includes a plate-shaped wiping member 42 that is attached to a rectangular prism-shaped wiper holder (wiper-supporting member) 41 such that the wiping member 42 protrudes from the top surface of the wiper holder 41. The guide portion 53 has a pair of guide grooves 53*a* that face each other in the left-right direction (direction perpendicular to the front-back direction and the vertical direction) with a predetermined gap therebetween, each guide groove 53*a* extending in the vertical direction. The ends of the wiper holder 41 in the width direction thereof (in the left-right direction) function as guided portions and are loosely fitted to the guide grooves 53*a*. The wiper holder 41 is inserted into the top opening of the guide portion 53 such that the guided portions of the wiper holder 41 are loosely fitted to the guide grooves 53*a*, and accordingly the wiper 40 is installed such that the wiper 40 can move in the vertical direction. The wiper holder 41 has a restricting portion 41*a* that is wider than the portion inserted into the guide portion 53 at the top end of the wiper holder 41. When the wiper holder 41 is inserted into the guide portion 53, the restricting portion 41*a* of the wiper holder 41 comes into contact with the top surface of the guide portion 53, thereby defining the lowermost position of the wiper 40. In addition, the wiper holder 41 has a recess 41*b* at a position corresponding to the stopper 86. When the cap 100 is moved downward to the standby position and the stopper 86 is at a retaining position, the stopper 86 extends through the recess 41*b* and is inserted into a retaining hole 71 formed in the cylindrical cam 67. The frame 51 also has a through hole 53*b* (see FIG. 3) at a position corresponding to the stopper 86, and the stopper 86 extends through the through hole 53*b* when the stopper 86 is at the retaining position.

Figure 8:
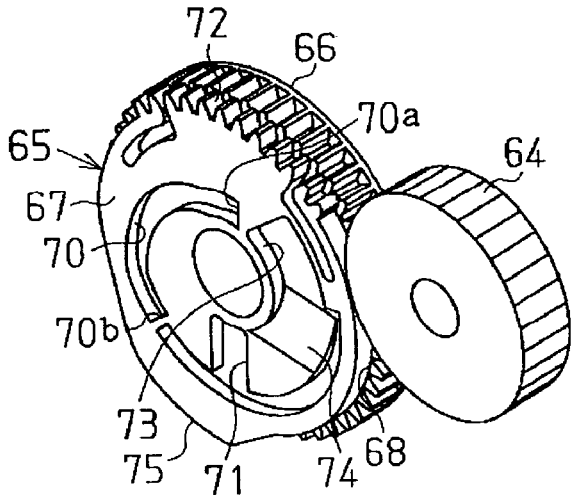
FIG. 8 is a perspective view of a friction clutch gear mechanism.

As described above, the columnar guide pin 43 that vertically projects from the back surface of the wiper holder 41 (the surface facing the power transmission mechanism 60) at a central position thereof is inserted into the cam groove 70 formed in the cylindrical cam 67 (see FIGS. 8, 9, and 11A). When the cylindrical cam 67 reciprocally rotates, the guide pin 43 is guided along the cam groove 70 so as to move in the vertical direction, and accordingly the wiper 40 is moved in the vertical direction. The wiping device includes the wiper 40, the guide portion 53, a portion of the power transmission mechanism 60 that forms the power transmission path leading to the wiper 40 (i.e., the input gear 61, the gear 64, and the friction clutch gear mechanism 65), and the electric motor 27. The cam groove 70 (cam portion) and the guide pin 43 (cam follower) form a second converting unit that converts the rotation of the cylindrical cam 67, which functions as a cam body, into the vertical movement of the wiper 40.

The wiper 40, the slider 80, and the cap 100 are arranged such that the centerlines thereof in the left-right direction substantially coincide with each other. In addition, the cylindrical cam 67 included in the friction clutch gear mechanism 65 is positioned such that the cylindrical cam 67 faces the slider 80 in the front-back direction (carriage-moving direction) when the slider 80 is at the lowermost position. Therefore, the wiper 40 and the cylindrical cam 67 are arranged so as to face each other in the front-back direction such that the centerline of the wiper 40 in the left-right direction and the axial line of the cylindrical cam 67 coincide with each other in the left-right direction. In addition, the guide pin 43 that projects from the back surface of the wiper 40 at the central position thereof is engaged with the cam groove 70 at a position above the axial line of the cylindrical cam 67. The wiper 40 and a portion of the guide portion 53 (a portion that functions both as a separation wall of the gear chamber and a part of the gear housing 54) are disposed between the slider 80 and the cam groove 70. Therefore, in order to form a path along which the stopper 86 that projects rearward from the slider 80 at a position near the centerline of the slider 80 in the width direction thereof becomes engaged with the cylindrical cam 67, the recess 41*b* is formed in the wiper holder 41 at the center of the bottom edge of the wiper holder 41 and the through hole 53*b* (see FIG. 3) is formed in the guide portion 53 at a position under the shaft 54*c*. In the present embodiment, the retaining hole 71 is formed at the bottom end of the cylindrical cam 67 in the state in which the cylindrical cam 67 is at a first rotational position (rotational angle position at the time when the wiper 40 is moved downward) and the stopper 86 passes through the recess 41*b* in the wiper 40 to become engaged with the retaining hole 71.

Thus, the cam groove 70, the retaining hole 71, and the protrusion 75 are all arranged on the cylindrical cam 67. Accordingly, a single component, that is, the cylindrical cam 67, provides the following four functions: an engaging component for the stopper 86, a cam body for the wiper 40, a cam body for the lock lever 45, and a component of the friction clutch gear mechanism 65.

FIG. 8 is a perspective view of the friction clutch gear mechanism 65, and FIGS. 11A to 13D illustrate the operation of the friction clutch gear mechanism 65. FIGS. 11A, 12A, and 13A are front views showing the operation of moving the wiper 40 vertically and pivoting the lock lever 45 in association with the rotation of the cylindrical cam 67 that engages with the guide pin 43 and the projection 47. FIG. 11B is a sectional view of FIG. 11A taken along line XIB-XIB that shows the positional relationship between the cylindrical cam 67 and the stopper 86, and FIGS. 12B and 13B are diagrams corresponding to FIG. 11B showing different operational states.

As shown in FIG. 8, the gear 64 (drive gear) meshes with the cylindrical gear 66 included in the friction clutch gear mechanism 65. In the friction clutch gear mechanism 65, the cylindrical gear 66 and the cylindrical cam 67 are assembled such that they can rotate relative to each other while opposing surfaces thereof are in contact with each other, and are frictionally engaged with each other at the contact surfaces (clutch surfaces) thereof due to the urging force applied by the coil spring 69 (see FIG. 3). The contact surfaces (clutch surfaces) of the cylindrical gear 66 and the cylindrical cam 67 and the coil spring 69 that applies a predetermined urging force for frictionally engaging the contact surfaces form a friction clutch 68 that is engaged and disengaged at the clutch surfaces. When the cylindrical gear 66 rotates, the cylindrical cam 67, which is positioned downstream of the contact surfaces in the power-transmitting direction, rotates together with the cylindrical gear 66 due to the frictional engagement obtained by the contact friction force (engagement friction force) between the contact surfaces as long as the load applied to the cylindrical cam 67 is equal to or less than a predetermined value (predetermined load). When the load applied to the cylindrical cam 67 exceeds the predetermined value, the clutch surfaces of the friction clutch 68 slip relative to each other and only the cylindrical gear 66 rotates, so that the cylindrical cam 67 is prevented from being rotated. The above-mentioned predetermined value is determined from the contact friction force that can provide frictional engagement between the clutch surfaces, and somewhat varies depending on the state of contact between the clutch surfaces.

As shown in FIG. 11A, the protrusion 75 that protrudes in a trapezoidal shape is provided on the outer periphery of the cylindrical cam 67. Side surfaces of the protrusion 75 at both ends thereof in the circumferential direction are inclined such that the distance from the axial center of the cylindrical cam 67 in the radial direction gradually varies, and an outer peripheral surface of the protrusion 75 has an arc shape. While the cylindrical cam 67 rotates in one direction, the lock lever 45 pivots upward when the projection 47 is engaged with one of the inclined surfaces of the protrusion 75 that faces front, is retained at the lock position when the projection 47 is engaged with the arc surface of the protrusion 75, and moves downward when the projection 47 is engaged with the other one of the inclined surfaces of the protrusion 75 that faces rear.

As described above, the cylindrical cam 67 has the cam groove 70 for receiving the guide pin 43 of the wiper 40 in the end surface opposite to the clutch surface. The cam groove 70 has a substantially arc shape, as shown in FIGS. 8 and 11A. As shown in FIG. 11A, the cam groove 70 is shaped such that the distance from the axial center of the cylindrical cam 67 to the cam groove 70 in the radial direction is increased as the cylindrical cam 67 rotates in the forward direction shown by the arrow in the figure (clockwise in the figure). The difference in the distance from the axial center of the cylindrical cam 67 to the cam groove 70 in the radial direction between one and the other ends of the cam groove 70 corresponds to the vertical stroke of the wiper 40. Accordingly, when the cylindrical cam 67 is rotated from the position shown in FIG. 11A to the position shown in FIG. 13A in the forward direction shown by the arrow in FIG. 11A, the guide pin 43 moves upward by being guided by the cam groove 70, thereby moving the wiper 40 upward from the standby position to the wiping position by the vertical stroke. Then, when the cylindrical cam 67 is rotated from the position shown in FIG. 13A to the position shown in FIG. 11A in the reverse direction shown by the arrow in FIG. 13A, the guide pin 43 inserted in the cam groove 70 moves downward by being guided by the cam groove 70, thereby moving the wiper 40 downward from the wiping position to the standby position by the vertical stroke.

The cylindrical cam 67 also has the retaining hole (retaining recess) 71 at a position where the retaining hole 71 faces the cam groove 70 across the axial center. The retaining hole 71 is used for retaining the stopper 86 on the cylindrical cam 67 when the cap 100 and the slider 80 are moved downward, and functions as an engaging portion with which the stopper 86 engages. When the cap 100 is at the standby position and the slider 80 is at the lower position, the stopper 86 is retained at the retaining position.

Figure 11B:
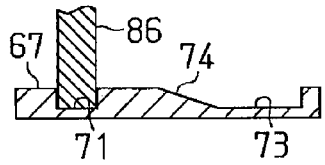
FIG. 11B is a schematic sectional view of a cylindrical cam taken along line XIB-XIB illustrating the operation of the friction clutch gear mechanism when the lock lever pivots and the wiper moves vertically.

When the cylindrical cam 67 is at the first rotational position shown in FIG. 11A and the wiper 40 and the lock lever 45 are at their standby positions, the stopper 86, which is at the retaining position, is inserted into the retaining hole 71 (see FIG. 11B). Therefore, when the cap 100 is at the standby position, the wiper 40 and the lock lever 45 are locked at the standby positions thereof due to the engagement of the stopper 86. In this state, even when the power of the electric motor 27 is transmitted to the cylindrical gear 66 and the cylindrical gear 66 rotates, the friction clutch 68 slips and only the cylindrical gear 66 rotates because a load higher than the predetermined load is applied to the cylindrical cam 67 due to the engagement with the stopper 86.

When the slider 80 moves upward and the cap 100 also moves upward from the standby position to a sealing position, the stopper 86 moves out from the retaining hole 71. Therefore, the cylindrical cam 67 can rotate forward from the first rotational position to the second rotational position (the position shown in FIG. 13A) and the wiper 40 can be moved from the standby position to the wiping position.

Figure 13A:
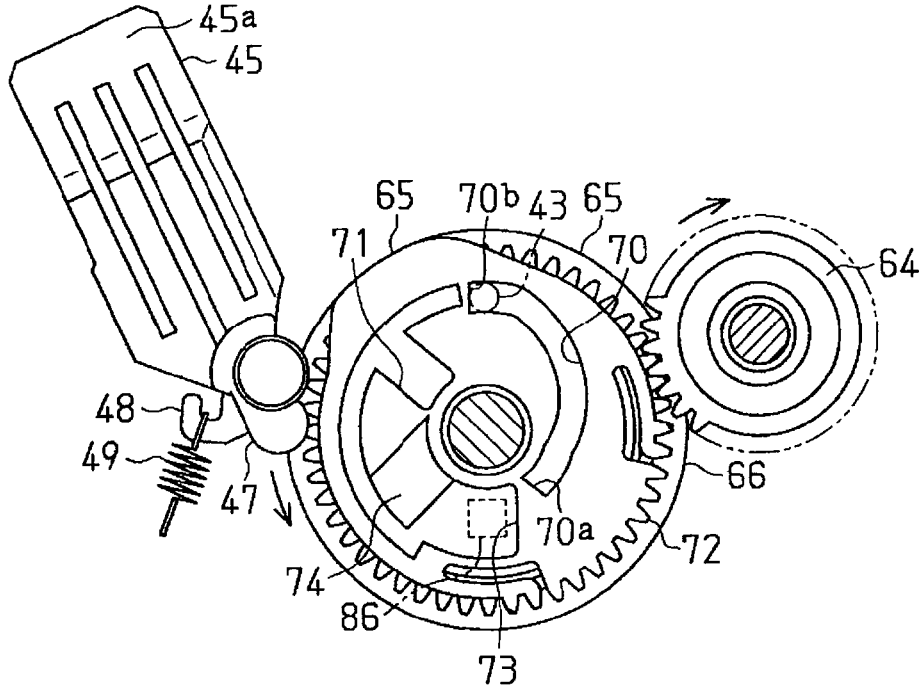
FIG. 13A is a front view of the section around the friction clutch gear mechanism illustrating the operation of the friction clutch gear mechanism.

The cylindrical cam 67 has a recess 73 that is positioned so as to face the stopper 86 when the stopper 86 returns to the retaining position as the slider 80 moves downward while the cylindrical cam 67 is at the second rotational position shown in FIG. 13A. When the carriage 12 moves away from the home position toward the print area after the ink suction operation, the cap 100 moves downward as soon as the carriage 12 leaves the home position before wiping is performed. Accordingly, the stopper 86 returns to the retaining position and is inserted into the recess 73 formed in the cylindrical cam 67 at the second rotational position (see FIG. 13C). Thus, even when the slider 80 is moved downward while the wiper 40 is at the wiping position, the recess 73 allows the stopper 86 to move downward to the lowermost position, similar to the case in which the stopper 86 is inserted in the retaining hole 71. In addition, the recess 73 also prevents the stopper 86 from strongly hitting the cylindrical cam 67 due to the urging force of the coil spring 115 when the slider 80 moves downward.

The recess 73 has an inclined surface 74 along which the stopper 86 inserted in the recess 73 moves relative to the cylindrical cam 67 as the cylindrical cam 67 rotates in the reverse direction from the second rotational position (FIG. 13A) to the first rotational position (FIG. 11A). The depth of the inclined surface 74 is gradually reduced from the same depth as that of the recess 73 in the direction in which the stopper 86 moves relative to the cylindrical cam 67 as the cylindrical cam 67 rotates in the reverse direction. Therefore, when the electric motor 27 is driven in the forward direction from the state shown in FIG. 13A, the stopper 86 can move out of the recess 73 along the inclined surface 74, as shown in FIG. 13D, thereby allowing the reverse rotation of the cylindrical cam 67. Accordingly, the inclined surface 74 functions as a movement-allowing surface that allows the movement of the stopper 86 along the path from the recess 73 to the retaining hole 71, thereby allowing the reverse rotation of the cylindrical cam 67 for moving the wiper 40 from the wiping position to the standby position. The inclined surface 74, which functions as the movement-allowing surface, forms an engagement-canceling unit.

The cylindrical cam 67 has a tooth portion 72 that extends along the outer periphery thereof within a predetermined angular range (about 90° in the present embodiment). The tooth portion 72 is formed at a predetermined portion of the cylindrical cam 67 so that the tooth portion 72 directly meshes with the gear 64 when the wiper 40, which moves vertically when the cylindrical cam 67 is rotated and the guide pin 43 is guided along the cam groove 70, is in a central area (intermediate range) of the vertical stroke excluding the standby position and the wiping position. In other words, the tooth portion 72 is formed at a predetermined area of the cylindrical cam 67 such that the tooth portion 72 can directly mesh with the gear 64 when the cylindrical cam 67 is in an intermediate range within a limited rotation range thereof. Therefore, when the gear 64 rotates, the power is directly transmitted from the gear 64 to the tooth portion 72 so as to reliably rotate the cylindrical cam 67 while the wiper 40 is in the intermediate range within the vertical stroke. An area free from the tooth portion 72 along the outer periphery of the cylindrical cam 67 does not mesh with the gear 64. Accordingly, the cylindrical cam 67 does not mesh with the gear 64 while the cylindrical cam 67 is at a rotational position where the guide pin 43 is at either end of the cam groove 70. While the gear 64 does not mesh with the tooth portion 72, the rotation is transmitted to the cylindrical cam 67 only by the frictional engagement between the cylindrical gear 66 and the cylindrical cam 67. Therefore, when the guide pin 43 reaches one end (first end face 70*a*) of the cam groove 70, the friction clutch 68 slips and only the cylindrical gear 66 rotates while further rotation (forward rotation) of the cylindrical cam 67 is restricted. Similarly, when the guide pin 43 reaches the other end (second end face 70*b*) of the cam groove 70, the friction clutch 68 slips and only the cylindrical gear 66 rotates while further rotation (reverse rotation) of the cylindrical cam 67 is restricted. Thus, the friction clutch gear mechanism 65 functions as a finite-range rotating mechanism in which the cylindrical cam 67 reciprocally rotates within a predetermined angular range even when the cylindrical gear 66 continuously rotates in either forward or reverse direction.

As shown in FIG. 11A, the position at which the protrusion 75 is formed and the center angle of the protrusion 75 with respect to the cylindrical cam 67 (about 30° in the present embodiment) are set such that the protrusion 75 engages with the projection 47 only when the cylindrical cam 67 is at an intermediate position within the finite range. The protrusion 75 does not engage with the projection 47 until the cylindrical cam 67 rotates by a predetermined amount from the first rotational position. Therefore, as is clear from FIGS. 11A, 12A, and 13A, an operation timing is set such that the wiper 40 starts to move upward first, and then the lock lever 45 starts to pivot upward and reaches the lock position. Then, after the cylindrical cam 67 further rotates about 30°, the lock lever 45 pivots downward and reaches the standby position. Then, the wiper 40 reaches the wiping position. This operation timing to return the lock lever 45 to the standby position before wiping is performed by the wiper 40 that waits at the wiping position. After wiping, the lock lever 45 reciprocates once while the cylindrical cam 67 is rotated in the reverse direction to return the wiper 40 to the standby position from the wiping position. At this time, the operation timing is set such that the lock lever 45 reciprocates once after the wiper 40 starts to move downward, so that the lock lever 45 is reliably prevented from coming into contact with the recording head 18. In addition, according to this operation timing, the wiper 40 is prevented from being placed at the wiping position when the lock lever 45 is disposed at the lock position while the recording apparatus is in the standby state in which capping is performed.

In the present embodiment, a part of the cam portion for the lock lever 45 that engages with the lock lever 45 to place the lock lever 45 at the lock-position is formed as the protrusion 75. However, instead of the protrusion 75, a part of the cylindrical peripheral surface (arc-shaped surface) of the cylindrical cam 67 may also be used. In this case, the cylindrical cam 67 is structured to have a small-diameter portion whose diameter is smaller than that of the cylindrical outer surface, and the lock lever 45 is placed at the standby position when the small-diameter portion faces the projection 47.

Thus, in the present embodiment, the cylindrical cam 67 has cam surfaces of two kinds of cam portions so that the lock lever 45, which functions as the first maintenance component, reciprocates once and the wiper 40, which functions as the second maintenance component, moves upward or downward in a single direction while the cylindrical cam 67 rotates in a certain direction within the finite range. In addition, the cam surfaces are set such that the reciprocation of the first maintenance component is performed at an intermediate period within the movement of the second maintenance component.

Figure 14A:
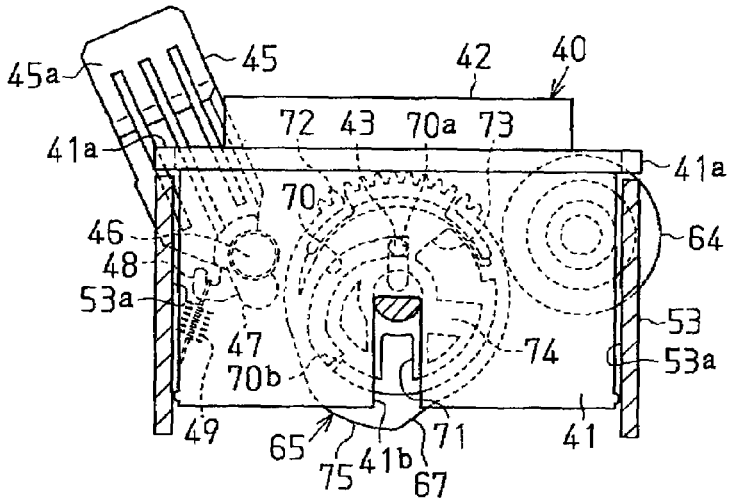
FIGS. 14A, 14B, and 14C are plan views illustrating the lock lever and a wiper-elevating mechanism.

Next, movements of the carriage lock device and the wiping device will be described below with reference to FIGS. 14A to 14C. In the figures, a portion of the frame 51 positioned between the wiper and the power transmission mechanism is omitted. In FIG. 14A, the cylindrical cam 67 is at the first rotational position. At the first rotational position, the projection 47 of the lock lever 45 is not engaged with the protrusion 75 and the lock lever 45 is at the standby position. In addition, the guide pin 43 is positioned near the first end face 70*a* of the cam groove 70 and the wiper 40 is at the standby position. If the cap 100 is at the standby position, the stopper 86 is inserted into the retaining hole 71 so that the wiper 40 cannot move upward. If the cap 100 is at the sealing position, the stopper 86 is removed from the retaining hole 71. When the power for rotating the cylindrical cam 67 forward is input in this state, the wiper 40 starts to move upward. Then, within a short time, the lock lever 45 starts to pivot upward.

Figure 14B:
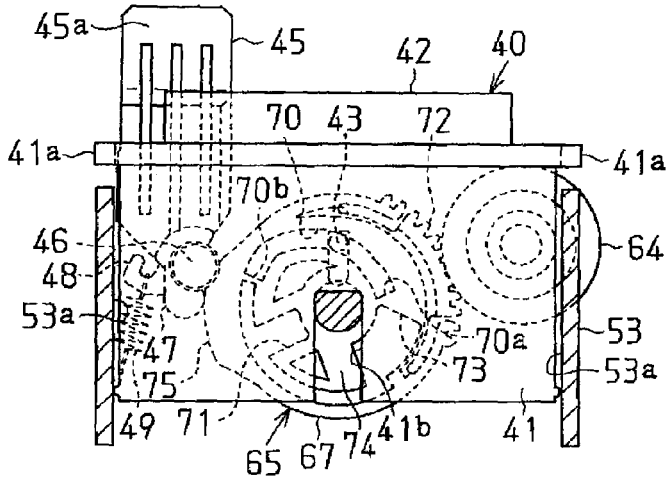

In FIG. 14B, the cylindrical cam 67 is rotated forward from the first rotational position by a predetermined amount (one-half of the amount of rotation between the first rotational position and the second rotational position (for example, about 30°)). At this position, the guide pin 43 is at an intermediate position of a guiding path of the cam groove 70 and the wiper 40 is at an intermediate position between the standby position and the wiping position. When the wiper 40 is at an intermediate position of the vertical stroke, the gear 64 meshes with the tooth portion 72 and the rotation of the gear 64 is directly transmitted to the cylindrical cam 67, so that the wiper 40 and the lock lever 45 are reliably moved upward. In addition, when the projection 47 engages with the protrusion 75 while the wiper 40 is moving upward or downward, the lock lever 45 moves to the lock position shown in FIG. 14B. The lock lever 45 is retained at the lock position while the projection 47 is engaged with the protrusion 75.

Figure 14C:
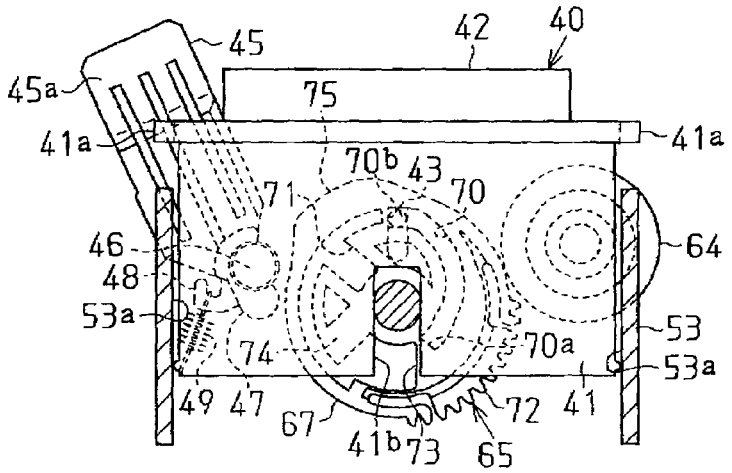

FIG. 14C shows the state in which the cylindrical cam 67 is at the second rotational position. The guide pin 43 is positioned near the second end face 70*b* and the wiper 40 is at the wiping position. The engagement of the projection 47 and the protrusion 75 is canceled before the wiper 40 reaches the wiping position and the lock lever 45 is at the standby position shown in the figure.

Accordingly, when the cylindrical cam 67 starts to rotate forward from the state in which the wiper 40 and the lock lever 45 are at the standby positions thereof as shown in FIG. 14A, the wiper 40 starts to move upward from the standby position. While the wiper 40 is moving upward, the lock lever 45 is moved to the lock position, as shown in FIG. 14B. Then, the engagement between the projection 47 and the protrusion 75 is canceled and the lock lever 45 returns to the standby position, as shown in FIG. 14C. Then, the wiper 40 reaches the wiping position, as shown in FIG. 14C. In reverse, when the cylindrical cam 67 starts to rotate in the reverse direction from the state in which the wiper 40 is at the wiping position and the lock lever 45 is at the standby position as shown in FIG. 14C, the wiper 40 moves from the wiping position to the standby position shown in FIG. 14A via the intermediate position shown in FIG. 14B. While the wiper 40 is moving downward, the lock lever 45 reciprocates once between the standby position and the lock position.

Capping Device

Next, the capping device will be described in detail below.

The guide frame 52 has a pair of side walls 51*a* and 51*b* that face each other in the left-right direction. Each of the side walls 51*a* and 51*b* has a pair of guide holes (a first guide hole 58 and a second guide hole 59). The first and second guide holes 58 and 59 are inclined such that the height thereof is increased from the back end toward the front end in the moving direction of the recording head 18 (longitudinal direction of the frame 51). Thus, the guide frame 52 has slopes defined by the bottom surfaces of the guide holes 58 and 59.

On each side of the guide frame 52, the first guide hole 58 has a lower flat portion 58*a*, an inclined portion 58*b*, and an upper flat portion 58*c* which are formed continuously. In addition, the second guide hole 59 has a lower flat portion 59*a*, an inclined portion 59*b*, and an upper flat portion 59*c* which are formed continuously. At least one of the first guide hole 58 and the second guide hole 59 may be replaced by a cutout or a guiding groove (guiding recess) that is open at one end thereof. The guide holes 58 and 59 form a cam.

The slider 80 has a first support pin 82 and a second support pin 83 that respectively project outward from a side surface 81*a* of the slider 80 at the front end and the back end of the side surface 81*a*. Similarly, a first support pin 84 and a second support pin 85 project outward from the other side surface 81*b* of the slider 80. The first support pins 82 and 84 are inserted into the first guide holes 58 and the second support pins 83 and 85 are inserted into the second guide holes 59. The first support pins 82 and 84 and the second support pins 83 and 85 form a cam follower corresponding to the above-mentioned cam.

The first support pins 82 and 84 and the second support pins 83 and 85 slide along the guide holes 58 and 59 so that the slider 80 can slide relative to the frame 51 in the moving direction of the recording head 18 (vertical direction in FIG. 4). The slider 80 is moved upward when it slides forward (upward in FIG. 4) relative to the frame 51 and is moved downward when it slides backward (downward in FIG. 4) relative to the frame 51.

As shown in FIG. 6, a coil spring 115 (tension spring) is stretched between a spring-receiving portion 52*c* and a spring-receiving portion 88 at the bottom of the maintenance unit 50. The spring-receiving portion 52*c* projects from a bottom section of the side wall 51*a* at a position near the front end, and the spring-receiving portion 88 projects from a bottom section of the slider 80 at a position near the back end. Accordingly, the slider 80 is urged backward (toward the print area) and downward by the coil spring 115. The guide holes 58 and 59 and the support pins 82 to 85 form a unit for converting the movement of the carriage 12 into a vertical movement of the cap 100, which will be described below.

As shown in FIG. 3, the slider 80 has a two-step structure including a higher step portion (front portion) and a lower step portion (rear portion). As shown in FIG. 4, a coil spring 120 (compression spring) is assembled to a bottom section 87 of the lower step portion such that the axial center of the cap 100 and that of the coil spring 120 coincide with each other. The cap 100 is assembled to the slider 80 such that the cap 100 can slide relative to the slider 80 in the vertical direction while being urged upward by the coil spring 120. The upper limit and the lower limit of the slidable range of the cap 100 are defined by the engagement between the cap 100 and the slider 80. For example, as shown in FIGS. 3 and 4, the cap 100 is guided at the center of the front side and the left and right ends of the back side by guide portions 89 and 90 provided on the slider 80. Thus, the cap 100 is supported such that the cap 100 can slide in the vertical direction with the upper limit of the slidable range being defined. In addition, the cap 100 has a pair of flange portions 112 that project outward in the left-right direction. The flange portions 112 come into contact with the upper edges of the side surfaces 81*a* and 81*b* surrounding the lower step portion of the slider 80, thereby defining the lower limit of the slidable range of the cap 100. A pair of L-shaped guide arms 91 are provided so as to project upward at the left and right edges of the cap 100 for holding and guiding the recording head 18 disposed therebetween when the cap 100 is moved upward to the sealing portion.

The bottom section 87 of the lower step portion has a circular hole 95 (see FIG. 6) centered on the axial center of the coil spring 120. The tube 30 that is connected to a connection tube (not shown) of the cap 100 projects from the bottom side of the slider 80 and is guided through the circular hole 95. The tube 30 is connected to a negative pressure port of the suction pump 29.

As shown in FIGS. 3 and 4, the above-described projections 98 are formed integrally with the slider 80 so as to project upward at the front edge of the slider 80. As shown in FIG. 9, when the carriage 12 moves to the home position, a lower front face 12*b* of the carriage 12 comes into contact with the projections 98, and accordingly the slider 80 is moved forward and raised upward. The slider 80, the frame 51 having the guide holes 58 and 59, etc., form an elevator unit (elevator mechanism) for moving the cap 100 in the vertical direction.

The cap 100 includes a cap holder 101 that functions as a main body and a sealing wall 102 that is composed of an elastic material, such as rubber (e.g., elastomer), and formed so as to surround the cap holder 101. In the present embodiment, the sealing wall 102 is formed integrally with the main body of the cap 100, which is a resin mold, by co-injection molding. In the present embodiment, the sealing wall 102 has a rectangular shape in plan view. A liquid-absorbing material 110 is contained in the recess surrounded by the sealing wall 102 in the cap 100. The tube 30 communicates with a hole formed in the bottom surface of the recess containing the liquid-absorbing material 110, and accordingly the inner space of the cap 100 communicates with the suction pump 29 via the tube 30.

Next, the operations of the recording apparatus and the maintenance unit 50 having the above-described structures will be described.

When the recording sheet 17 is fed, conveyed, or ejected, the electric motor 27 is rotated forward. The recording sheet 17 is fed by the rotation of the paper feed roller 32 and is held between the rollers 23 and 24. Then, when the electric motor 27 is continuously rotated forward, the driving roller 23 continues to rotate. Thus, the paper conveying operation is performed continuously after the paper feed operation. When the leading edge of the recording sheet 17 is detected by the sensor S while the recording sheet 17 is being conveyed, the control unit 33 further conveys the recording sheet 17 forward from the detection position of the sensor S by a set conveying amount corresponding to the cueing position. Then, the electric motor 27 is rotated forward for performing the cueing operation. The control unit 33 acquires print setting information, such as a top margin, from the print data received from a host computer (not shown) and determines the cueing position on the basis of the information of the top margin. In the cueing operation, the recording sheet 17 is once conveyed forward beyond the cueing position and is then conveyed backward. Then, the electric motor 27 is rotated slightly forward to cancel backlash, so that high-accuracy cueing operation can be performed. With regard to the control method for moving the recording sheet 17 forward and then backward in the cueing operation, other methods may also be used. For example, in an apparatus having a paper detection sensor at a position closer to a paper ejection slot than the recording head 18, the cueing operation is performed such that the recording sheet 17 is conveyed backward after the leading edge of the recording sheet 17 is detected by the paper detection sensor. On the other hand, the control unit 33 may also rotate the electric motor 27 in the reverse direction when, for example, paper jam occurs in which the recording sheet 17 is jammed between the rollers 23 and 24 and a predetermined switch on the operation panel is operated to remove the recording sheet 17. Accordingly, the rollers 23 and 24 are rotated in the reverse direction and the recording sheet 17 is conveyed backward.

When the electric motor 27 is rotated forward in the cueing operation, the input gear 61 of the power transmission mechanism 60 is rotated in the reverse direction. Since the pump gear 63 is rotated in the reverse direction due to the reverse rotation of the gear 61, the suction pump 29 is maintained in the released state. The reverse rotation of the gear 61 is also transmitted to the friction clutch gear mechanism 65 via the gear 64. At this time, the wiper 40 and the cap 100 are both at the standby positions thereof, and therefore the slider 80 is at the lowermost position and the stopper 86 is inserted into the retaining hole 71 formed in the cylindrical cam 67. In addition, the projection 47 of the lock lever 45 is not engaged with the protrusion 75 of the cylindrical cam 67, and the guide pin 43 of the wiper 40 is positioned near the first end face 70*a* of the cam groove 70 of the cylindrical cam 67. Therefore, even when the reverse rotation is transmitted to the friction clutch gear mechanism 65, the cylindrical cam 67 receives a load higher than the predetermined value due to the engagement of the stopper 86 and the engagement between the guide pin 43 and the first end face 70*a*. Accordingly, the friction clutch 68 slips and only the cylindrical gear 66 rotates while the cylindrical cam 67 is stationary. As a result, the lock lever 45 and the wiper 40 are both retained at the standby positions.

When the electric motor 27 is rotated in the reverse direction for moving the recording sheet 17 backward at the end of the cueing process, the gear 61 rotates forward. When the gear 61 rotates forward, the pump gear 63 also rotates forward. However, the suction pump 29 is not driven unless the amount of backfeed of the recording sheet 17 exceeds the amount of rotation delayed by the delaying member of the pump gear 63. When the amount of backfeed exceeds the amount of rotation delayed by the delaying member, the suction pump 29 is driven and a negative pressure is generated. However, since the carriage 12 is already moved away from the home position toward the print start position when the cueing operation is performed, ineffective suction operation is simply performed by the cap 100 and no problem occurs. In addition, also during the backward conveyance of the recording sheet 17, the lock lever 45 and the wiper 40 are retained at the standby positions thereof because the rotation of the cylindrical cam 67 is restricted due to the engagement of the stopper 86. Even when the amount of backfeed of the recording sheet 17 exceeds the amount of rotation delayed by the delaying member of the pump gear 63, the lock lever 45 and the wiper 40 can both be retained at the standby positions.

After the cueing operation of the recording sheet 17, the operation of printing a character string, an image, etc., corresponding to the print data on the recording sheet 17 is performed. More specifically, a process of moving the carriage 12 in the main-scanning direction (X direction in FIG. 1) while discharging (ejecting) ink from the recording head 18 and a process of moving the recording sheet 17 in the sub-scanning direction (Y direction in FIG. 1) by a predetermined amount are alternately performed.

Then, when, for example, a user notices a print defect and operates the cleaning switch 28 or when the time measured by the timer 39 reaches a set time that corresponds to the time at which cleaning (ink suction operation) is to be performed, the cleaning operation is performed. When the cleaning operation is performed, the carriage 12 moves from the print area toward the home position.

The control unit 33 controls the carriage motor 16 so as to move the carriage 12 to the home position. The carriage 12 leaves the print area and engages with the projections 98 before reaching the home position. The carriage 12 moves further toward the home position while pushing the projections 98, so that the slider 80 slides forward and upward by being guided by the guide holes 58 and 59. As the slider 80 moves upward, the cap 100 moves upward from the standby position to the sealing position and seals the nozzle surface 18*a*. In addition, as the slider 80 slides forward, the stopper 86 moves away from the retaining position toward a released position and leaves the retaining hole 71. Thus, the engagement between the stopper 86 and the cylindrical cam 67 as the cap 100 moves upward.

When it is determined that the carriage 12 has reached the cleaning position (home position) on the basis of the signal obtained from the encoder 36, the control unit 33 outputs a reverse rotation signal to the motor-driving circuit 35 in order to start the cleaning operation. Accordingly, the electric motor 27 is rotated in the reverse direction and the gear 61 is rotated forward, so that the pump gear 63 is also rotated forward. Then, after the pump gear 63 is rotated by an amount corresponding to the amount of rotation delayed by the delaying member, the power of the pump gear 63 is transmitted to the driving shaft of the suction pump 29 and the suction pump 29 starts to operate. Then, when a negative pressure is generated in an inner space of the cap 100 due to a pump function provided by the operation of the suction pump 29, ink is absorbed and ejected through the nozzle holes formed in the nozzle surface 18*a*. The thus ejected waste liquid is discharged from the cap 100 to the waste liquid tank 31 through the suction pump 29.

Before or after the operation of suction pump 29, the gear 64, which meshes with the input gear 61, rotates forward in response to the forward rotation of the input gear 61. The rotation of the gear 64 is transmitted to the friction clutch gear mechanism 65. At this time, the stopper 86 is released from the retaining hole 71 and the cylindrical cam 67 is unlocked. Therefore, when the rotation of the gear 64 is transmitted to the cylindrical gear 66, the cylindrical cam 67 rotates forward together with the cylindrical gear 66 from the first rotational position (FIG. 11A) to the second rotational position (FIG. 13A).

Figure 12A:
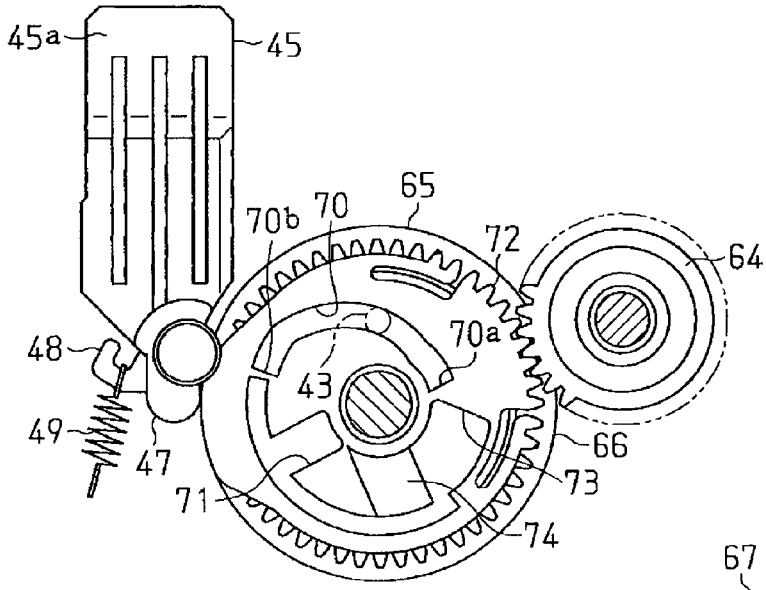
FIG. 12A is a front view of the section around the friction clutch gear mechanism illustrating the operation of the friction clutch gear mechanism.
Figure 12B:
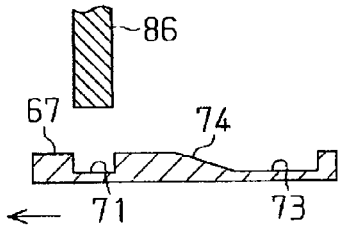
FIG. 12B is a schematic sectional view of the cylindrical cam illustrating the operation of the friction clutch gear mechanism.

During this time, the gear 64 meshes with the tooth portion 72, as shown in FIG. 12A, and the rotating force of the gear 64 is directly transmitted to the cylindrical cam 67. Therefore, when the wiper 40 moves upward in an intermediate range within the movable range thereof, the cylindrical cam 67 can be reliably rotated forward even if the load applied to the cylindrical cam 67 varies due to, for example, frictional resistance in the sliding area or when the clutch surfaces of the friction clutch 68 slip easily than usual. Therefore, the lock lever 45 can be reliably moved upward to the lock position and then returned to the standby position, and the wiper 40 can be reliably moved upward to the wiping position.

Therefore, when the carriage 12 reaches the home position and stops, the lock lever 45 can be positioned at the lock position, as shown in FIG. 9. Accordingly, the movement of the carriage 12 from the home position toward the print area is restricted and the cap 100 comes into contact with the nozzle surface 18*a* while the carriage 12 is accurately disposed at the home position. Accordingly, capping can be reliably performed.

After capping, the amount of rotation of the pump gear 63 exceeds the amount of rotation delayed by the delaying member and the driving shaft of the suction pump 29 is rotated. Accordingly, a negative pressure is generated in the cap 100 and the ink suction operation is performed. During the ink suction operation, the electric motor 27 is continuously driven in the reverse direction. However, since the guide pin 43 comes into contact with the first end face 70*a* of the cam groove 70 and further rotation of the cylindrical cam 67 is restricted, the friction clutch 68 slips and only the cylindrical gear 66 rotates while the cylindrical cam 67 is retained at the second rotational position (FIG. 13A). As a result, the lock lever 45 is held at the standby position and the wiper 40 is held at the wiping position.

Then, when the electric motor 27 is rotated in the reverse direction by an amount set in advance and the ink suction operation is finished, the control unit 33 drives the carriage motor 16 so as to move the carriage 12 away from the home position toward the print area. As the carriage 12 moves, the slider 80 moves rearward together with the carriage 12 since the slider 80 is urged rearward by the coil spring 115. At this time, the support pins 82 to 85 are guided along the first guide holes 58 and the second guide holes 59 so that the slider 80 move downward while sliding rearward. As a result, the cap 100 mounted on the slider 80 is moved downward, so that the nozzle surface 18*a* is released from the cap 100 and the cap 100 returns to the standby position.

Then, when the carriage 12 is moved by a predetermined distance (for example, 10 mm to 20 mm) after the slider 80 reaches the lowermost position and is further moved toward the print area, the carriage 12 passes through the wiping position where the wiping member 42 of the wiper 40 positioned at the wiping position slides along the nozzle surface 18*a*. Thus, wiping of the nozzle surface 18*a* is performed. In the wiping operation, ink that adheres to the nozzle surface 18*a* is wiped off and meniscus in the nozzle holes is adjusted.

Figure 13B:
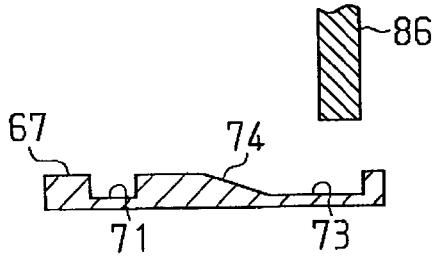
FIGS. 13B, 13C, and 13D are schematic sectional views of the cylindrical cam illustrating the operation of the friction clutch gear mechanism.
Figure 13C:
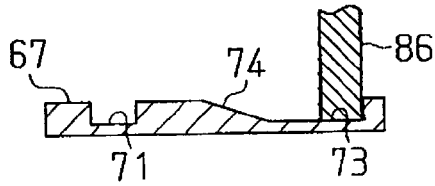
Figure 13D:
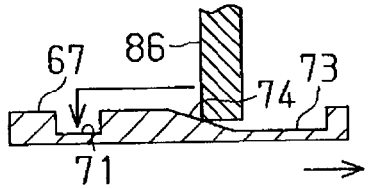

When the wiping operation is finished (when the carriage 12 leaves the wiping position), the slider 80 is already moved to the lowermost position and the stopper 86 is at the retaining position (the stopper 86 is moved from the position shown in FIG. 13B to that shown in FIG. 13C). Accordingly, the stopper 86 is placed in the recess 73 formed in the cylindrical cam 67 that is disposed at the second rotational position shown in FIG. 13A. Since the stopper 86 can be received by the recess 73, the cap 100 can be moved to the lowermost position, similar to the case in which the stopper 86 is inserted in the retaining hole 71. In addition, since the recess 73 is provided, the stopper 86 is prevented from strongly hitting the cylindrical cam 67 due to the urging force of the coil spring 115 when the slider 80 moves downward. Accordingly, the components of the power transmission mechanism 60 are prevented from being strongly impacted.

When it is determined that the carriage 12 has reached the wiping end position on the basis of the signal from the encoder 36, the control unit 33 transmits a forward rotation signal to the motor-driving circuit 35. Accordingly, the electric motor 27 is rotated forward and the cylindrical cam 67 is rotated in the reverse direction from the second rotational position (FIG. 13A) to the first rotational position (FIG. 11A). While the cylindrical cam 67 rotates in the reverse direction, since the inclined surface 74 is provided, the stopper 86 does not engage with any portion of the cylindrical cam 67. Therefore, the stopper 86 moves out of the recess 73 by sliding along the inclined surface 74, as shown in FIG. 13D, and moves relative to the cylindrical cam 67 along an arc-shaped trajectory until the stopper 86 reaches the retaining hole 71. Then, the stopper 86 is inserted into the retaining hole 71. Thus, the cylindrical cam 67 rotates in the reverse direction from the second rotational position to the first rotational position without being engaged with the stopper 86. Due to the reverse rotation of the cylindrical cam 67, the guide pin 43 guided by the cam groove 70 is moved downward by a distance corresponding to the vertical stroke of the wiper 40. As a result, the wiper 40 moves downward from the wiping position to the standby position. Also when the wiper 40 moves downward, the gear 64 meshes with the tooth portion 72 (FIG. 12A) so that the rotating force of the gear 64 is directly transmitted to the cylindrical cam 67 and the wiper 40 can be reliably moved downward to the standby position.

Then, when the wiper 40 is moved downward to the standby position, the guide pin 43 comes into contact with the second end face 70*b* of the cam groove 70 and further rotation of the cylindrical cam 67 in the reverse direction is restricted. Therefore, even when the electric motor 27 is rotated forward for the purpose of, for example, the paper feed operation after cleaning is finished, the friction clutch 68 slips and only the cylindrical gear 66 is rotated. Therefore, components that are positioned downstream of the friction clutch 68 (clutch surfaces) in the power-transmitting direction and that include the cylindrical cam 67 disposed at the first rotational position shown in FIG. 11A are prevented from receiving an excessive load. The operation for returning the wiper 40 to the standby position may be performed at the time when the electric motor 27 is rotated forward for feeding the recording sheet 17 for the first time after the cleaning operation. When the cylindrical cam 67 is rotated in the reverse direction to move the wiper 40 downward, the lock lever 45 reciprocates once between the standby position and the lock position. However, the carriage 12 is moved to the print area and therefore the lock lever 45 is prevented from interfering with the recording head 18.

In addition, in the recording apparatus 10, flushing is performed as another cleaning operation. Each time the timer 39 determines that a set time that corresponds to a time cycle for the flushing operation has elapsed, the carriage 12 is moved to a flushing position where the recording head 18 faces a waste-liquid receiver (not shown). Then, flushing is performed in which ink droplets are ejected from the recording head 18 toward the waste-liquid receiver. More specifically, the control unit 33 applies a drive signal irrelevant to the print data to the recording head 18 and causes the recording head 18 to discharge ink droplets through the nozzle holes thereof. When the flushing operation is performed, wiping is not performed. However, wiping may, of course, be performed after the flushing operation. For example, flushing may be performed such that the ink droplets are discharged toward the cap 100. In such a case, a flushing position is defined as a carriage position at which the cap 100 is moved upward to an intermediate position between the standby position and the sealing position, so that the stopper 86 is released from the retaining hole 71 when the cap 100 reaches the intermediate position. Accordingly, the stopper 86 is disengaged from the retaining hole 71 when flushing is performed and the wiper 40 can be moved upward to the wiping position, so that wiping can be performed after the flushing operation. After the flushing operation, the carriage 12 is moved away from the flushing position toward the print area and the recording operation using the recording head 18 is restarted.

Although the reverse conveyance in the cueing operation is considered in the present embodiment, a function for conveying the recording sheet in the reverse direction in case of paper jam so that the recording sheet can be removed through a paper insertion slot may also be provided. In such a case, when the carriage 12 is at a position other than the home position, the cylindrical cam 67 is engaged with the stopper 86. Therefore, even when the electric motor 27 is rotated in the reverse direction to convey the recording sheet 17 in the reverse direction in response to a switch operation, the lock lever 45 and the wiper 40, which are the maintenance components, are prevented from moving upward. In this state, the recording sheet 17 can be conveyed in the reverse direction without a limit to the amount of backfeed. In addition, to provide a function of rotating the electric motor 27 in the reverse direction while the carriage is at the home position (cleaning position), a following control operation may be additionally performed. That is, if the control unit 33 determines that the carriage 12 is at the cleaning position when the reverse conveyance operation is to be started, the control unit 33 drives the carriage motor 16 so as to slightly move the carriage 12 toward the print area so that a gap is provided between the cap and the nozzle surface. Accordingly, even when the suction pump 29 is driven and a negative pressure is generated in the cap 100 while the recording sheet is conveyed in the reverse direction, ineffective suction is simply performed since a gap is provided and the ink suction operation for the recording head is not performed. In addition, since the stopper 86 is retained by the cylindrical cam 67, the lock lever 45 and the wiper 40 are locked in an inoperable state. Therefore, also in this case, the recording sheet 17 can be conveyed in the reverse direction without a limit to the amount of backfeed.

In addition, when the recording sheet 17 is being ejected, even if the carriage 12 is moved to the home position and the cap 100 is disposed at the sealing position, ink suction through the ink openings is not performed since the rotating direction of the suction pump 29 is set to the release direction. When a conveyance drive unit including the paper feed roller 32 is to be prevented from being driven in the reverse direction if the carriage 12 is disposed at the cleaning position and the pump operation of the suction pump 29 is performed, a clutch for disconnecting the power transmission path between the electric motor 27 and the conveyance drive unit while the carriage 12 is at the cleaning position is preferably provided.

When the carriage 12 is moved to the home position in the print standby period, the electric motor 27 is rotated in the reverse direction by a small amount and the cylindrical cam 67 is stopped at the rotational position shown in FIGS. 12A and 14B, so that the lock lever 45 is disposed at the lock position. As a result, the nozzle surface 18*a* is capped while the carriage 12 is retained at the home position in the print standby period. In this capping state, the wiper 40 is moved to an intermediate position. However, when the electric motor 27 is rotated forward for the purpose of, for example, paper feed after the capping state is canceled, the wiper 40 is moved downward from the intermediate position to the standby position and does not reach the wiping position. This operation can be performed because the operation timing of the maintenance components is set such that the lock lever 45 reaches the lock position before the wiper 40 reaches the wiping position when the electric motor 27 is rotated in the reverse direction.

The present embodiment provides the effects described below.

(1) When the carriage 12 is not positioned at the cleaning position (when the cap 100 is at the standby position) and cleaning is not performed, the stopper 86 is inserted into the retaining hole 71 so as to lock the cylindrical cam 67 such that the cylindrical cam 67 cannot rotate. Even if the electric motor 27 is rotated in the reverse direction for controlling the paper conveying system so as to, for example, move the recording sheet 17 in the reverse direction at the end of the cueing operation, the lock lever 45 and the wiper 40 are not moved upward and are retained at the standby positions thereof. Therefore, when the carriage 12 is moved to the home position afterwards, the recording head 18 is prevented from coming into contact with the lock lever 45 and the wiper 40. In addition, unlike the case in which the transmission-delaying unit described in JP-A-2005-144690 is provided, the recording sheet 17 can be conveyed in the reverse direction without limiting the amount of backfeed to the amount of rotation delayed by the transmission-delaying unit. Since the amount of backfeed can be set larger than the amount of rotation delayed by the transmission-delaying unit, an additional function regarding the backward conveyance can be easily performed by the recording apparatus 10. For example, when paper jam occurs, the recording sheet 17 can be conveyed in the reverse direction by operating the switch provided on the operation panel.

(2) The stopper 86 is provided on the slider 80 included in the elevating unit for the cap 100, and is inserted into the retaining hole 71, which functions as an engaging portion, formed in the cylindrical cam 67. The cylindrical cam 67 is one of the components of the power transmission mechanism 60 that are positioned downstream of the clutch surfaces of the friction clutch gear mechanism 65, which functions as a clutch unit, along the power transmission path. When the carriage 12 is not positioned at the cleaning position and cleaning is not performed, the stopper 86 is inserted into the retaining hole 71 so that the power transmission mechanism 60 is locked and the power is not transmitted to the maintenance components. Accordingly, when cleaning is not performed, the carriage lock device and the wiping device can be locked in an inoperable state using a simple structure obtained by adding the stopper 86 to the slider 80, which is included in the elevating unit for the cap 100, and forming the engaging portion in one of the components of the power transmission mechanism 60 at a position corresponding to the stopper 86. In other words, the retaining mechanism for the stopper 86 is structured using the elevating unit for the cap 100. Therefore, although the retaining mechanism is additionally provided, the number of components added is small. In addition, since the stopper 86 is inserted into the retaining hole 71 formed in the cylindrical cam 67, even though the stopper 86 and the retaining hole 71 are additionally provided, a space for accommodating the components of the maintenance unit 50 is barely increased. Thus, a small maintenance device can be obtained even though the retaining mechanism is provided.

(3) In addition, since the cylindrical cam 67 that functions as the cam body is used as an engaging component to which the stopper 86 is engaged, it is not necessary to provide an engaging component in addition to the cam body in the power transmission mechanism 60. Therefore, the power transmission mechanism 60 can be structured using a small number of components and the size of the power transmission mechanism 60 can be reduced. Accordingly, the size of the maintenance unit 50 can be reduced.

(4) The engaging component (cylindrical cam 67) to which the stopper 86 is engaged is obtained by forming the retaining hole 71 (engaging portion) in one of the components of the friction clutch gear mechanism 65 (clutch unit). Accordingly, one of the components of the friction clutch gear mechanism 65 also functions as the engaging component. Therefore, the power transmission mechanism 60 can be structured using a small number of components and the size of the power transmission mechanism 60 can be reduced. Accordingly, the structure of the maintenance unit 50 can be simplified and the size thereof, for example, can be reduced.

(5) The protrusion 75, which is the first cam portion included in the first converting unit for the lock lever 45 that functions as the first maintenance component, and the cam groove 70, which is the second cam portion included in the second converting unit for the wiper 40 that functions as the second maintenance component, are formed on a single cam body. Thus, a plurality of cam portions are provided on a single cam body, that is, on the cylindrical cam 67. Therefore, compared to the structure in which a plurality of cam portions included in a plurality of converting units for different maintenance components are independently provided on different cam bodies, the number of components of the power transmission mechanism 60 and the size thereof can be reduced. Accordingly, the structure of the maintenance unit 50 can be further simplified and the size thereof, for example, can be reduced.

(6) The cylindrical cam 67 that functions as the cam body is obtained by forming the protrusion 75 and the cam groove 70 in one of the components of the friction clutch gear mechanism 65 (clutch unit). Accordingly, one of the components of the friction clutch gear mechanism 65 also functions as the cam body having a plurality of cam portions. Therefore, the power transmission mechanism 60 can be structured using a small number of components and the size of the power transmission mechanism 60 can be reduced. Accordingly, the structure of the maintenance unit 50 can be further simplified and the size thereof, for example, can be reduced.

(7) The protrusion 75, which is the first cam portion included in the first converting unit, the cam groove 70, which is the second cam portion included in the second converting unit, and the retaining hole 71, which functions as the engaging portion, are all provided in one of the components included in the friction clutch gear mechanism 65 (clutch unit). Thus, a single component, that is, the cylindrical cam 67, serves as four functional components. Therefore, the power transmission mechanism 60 can be structured using a small number of components and the size of the power transmission mechanism 60 can be reduced. Accordingly, the structure of the maintenance unit 50 can be further simplified.

(8) The carriage lock mechanism and the wiper elevator mechanism are of the finite-range-rotating type in which the cylindrical cam 67 is reciprocally rotated within a finite range. In addition, the suction pump 29, the carriage lock device, and the wiping device are driven by a common rotational drive source, that is, the electric motor 27. In the power transmission mechanism 60, the power supplied to the suction pump 29 is divided at the gear 61 positioned upstream of the clutch surfaces of the friction clutch gear mechanism 65, which functions as the clutch unit, in the power-transmitting direction. Therefore, even when the suction pump 29 is continuously driven for a time required for the ink suction operation, the friction clutch 68 slips and disengages the friction clutch gear mechanism 65 when the rotation of the cylindrical cam 67 is restricted by the guide pin 43. Accordingly, the lock lever 45 can be held at the standby position and the wiper 40 can be held at the wiping position. Even after the maintenance components are moved to the predetermined positions, the suction pump 29 can be continuously driven by rotating the electric motor 27 that functions as the rotational drive source. Therefore, the suction pump 29 can be continuously driven for a required time or by a required amount of rotation without being limited by the finite range of the cylindrical cam 67 that functions as the cam body. Thus, the ink suction operation for sucking out ink from the nozzle holes in the nozzle surface 18*a* can be adequately performed.

(9) The paper feed motor (electric motor 27), which is originally included in the recording apparatus 10, is used as the rotational drive source for the maintenance unit 50. Therefore, it is not necessary to add an electric motor dedicated to the maintenance unit 50, and the number of electric motors to be installed in the recording apparatus 10 is not increased. In addition, the electric motor 27 also serves as a rotational drive source for the paper feed device, the paper ejecting device, and the suction pump 29. Thus, the number of electric motors to be installed in the recording apparatus 10 can be reduced. As a result, the arrangement space for the electric motors can be reduced, which contributes to a reduction in the size of the recording apparatus 10.

(10) The friction clutch gear mechanism 65 is arranged so as to face the slider 80 in the front-back direction (moving direction of the carriage) when the slider 80 is at the lowermost position. Accordingly, the retaining mechanism having a relatively simple structure can be obtained by forming the stopper 86 that projects toward the cylindrical cam 67 from back end surface of the protruding portion 80*a* of the slider 80 that faces the cylindrical cam 67 and forming the retaining hole 71 in the cylindrical cam 67 at a position corresponding to the stopper 86.

(11) In addition, the wiper 40 is disposed so as to face the slider 80 in the front-back direction when the slider 80 is at the lowermost position. The wiper 40 also faces the engaging component (cylindrical cam 67) that is included in the clutch gear mechanism 65 and that has the retaining hole 71. Therefore, the second converting unit having a relatively simple structure can be obtained by forming the guide pin 43 so as to projects from the wiper 40 toward the cylindrical cam 67 and forming the cam groove 70 in the cylindrical cam 67 at a position corresponding to the guide pin 43. In addition, the lock lever 45 is disposed adjacent to the cylindrical cam 67 that functions as the cam body and that also functions as one of the components of the friction clutch gear mechanism 65 (clutch unit). Therefore, the first converting unit having a simple structure can be obtained by additionally forming the protrusion 75 and the projection 47 on the cylindrical cam 67 and the lock lever 45, respectively.

(12) The cylindrical cam 67 is arranged such that the centerline of the slider 80 in the left-right direction, the centerline of the wiper 40 in the left-right direction, and the axial center of the cylindrical cam 67 coincide with one another in the left-right direction (Y direction). Therefore, the stopper 86 can be formed so as to project at a position near the centerline of the slider 80. In addition, the retaining hole 71 can be formed at a relatively low position near the bottom end of the cylindrical cam 67 and the cam groove 70 can be formed in an upper section so as to face the retaining hole 71 across the centerline of the cylindrical cam 67. Since the retaining hole 71 is formed at a position near the bottom end of the cylindrical cam 67, the stopper 86 can be inserted into the retaining hole 71 along a path that extends through a lower section of the wiper 40. In addition, the guide pin 43 can be engaged with the cam groove 70 for converting the rotation of the cylindrical cam 67 into the vertical movement of the wiper 40 at a position above the rotational center of the cylindrical cam 67. Therefore, the cam groove 70 and the retaining hole 71 can be arranged on a single rotating body (cylindrical cam 67).

(13) The cylindrical cam 67 provides functions as components included in the clutch unit, the first converting unit, and the second converting unit. While the cylindrical cam 67 rotates in one direction within the finite range thereof, the lock lever 45 (first maintenance component) reciprocates once and the wiper 40 (second maintenance component) moves in one direction in the reciprocating movement. Therefore, the lock lever 45 quickly moves to the standby position after locking the carriage 12, and the wiper 40 can be retained at the wiping position until the carriage 12 leaves the cleaning position and wiping is performed. Accordingly, the structure for operating a plurality of maintenance components at different timings can be obtained using a small number of components.

(14) Since the friction clutch gear mechanism 65 is used, even when the electric motor 27 is continuously rotated in the reverse direction for the ink suction operation, the friction clutch 68 slips and the power is not transmitted from the electric motor 27 to the cylindrical cam 67 after the lock lever 45 reciprocates once between the standby position and the lock position and the wiper 40 moves upward and reaches the wiping position. Therefore, the carriage lock device and the wiping device are prevented from receiving an excessive load.

(15) The tooth portion 72 is formed on the cylindrical cam 67 so that the gear 64 meshes with the tooth portion 72 and the power of the gear 64 is directly transmitted to the cylindrical cam 67 when the wiper 40 is in the intermediate range within the vertical stroke. Therefore, the lock lever 45 can be reliably pivoted upward and downward and the wiper 40 can be reliably moved upward or downward. Accordingly, even if the frictional resistance is increased in the sliding area and the cylindrical cam 67 receives a large load when the wiper 40 is moved vertically or if the clutch surfaces of the friction clutch 68 slip easily than usual, the lock lever 45 and the wiper 40 can be reliably moved without delay. As a result, the situation can be prevented where the operations of carriage locking and wiping cannot be adequately performed due to the delay or failure in the upward and downward movements of the lock lever and the wiper. In addition, the lock lever and the wiper can be prevented from coming into contact with the recording head 18.

(16) Since the cylindrical cam 67 has the inclined surface 74, even if the stopper 86 is already at the retaining position when the wiper 40 is to be moved from the wiping position to the standby position after wiping, the stopper 86 can slide along the inclined surface 74 and move out from the recess 73. Thus, the stopper 86 is prevented from engaging with the cylindrical cam 67 so as to restrict the rotation of the cylindrical cam 67 in the reverse direction for returning the wiper 40 to the standby position. Accordingly, the wiper 40 can be returned to the standby position even after the wiping operation is finished. Instead of the method used in the present embodiment, the wiper 40 may also be returned to the standby position after the wiping operation by, for example, moving the carriage to the home position again, so that the slider moves upward and the stopper is pulled out from a recess that is free from the inclined surface, and then rotating the electric motor 27 forward. However, in this case, an additional operation of moving the carriage 12 to the home position again must be performed. Therefore, the print throughput is reduced. In comparison, according to the present embodiment, such an additional movement of the carriage 12 is not necessary. Accordingly, the wiper 40 can be adequately operated without reducing the print throughput.

The invention is not limited to the above-described embodiment, and the following modifications are also possible.

First Modification

In the above-described embodiment, the stopper is formed integrally with the slider and moves in association with the vertical movement of the slider. However, it is not necessary that the stopper be formed integrally with the slider. For example, the stopper may also be operated by a retaining mechanism that does not use the moving unit for the cap and be moved from a retaining position to a released when an engaging portion of the carriage pushes another engaging portion as the carriage moves to the cleaning position. In this case, the moving unit for the cap may be structured such that the cap is moved upward by causing the carriage to push a slider. When this retaining mechanism is applied, the stopper follows or moves in association with the movement of the carriage in a predetermined area before the cleaning position and the vertical movement of the cap.

Second Modification

In the above-described embodiment, the lock lever 45 and the wiper 40 are both locked in an inoperable state by causing the stopper 86 to engage with the movable body (cylindrical cam 67). However, the structure may also be such that only one of the lock lever 45 and the wiper 40 is locked in an inoperable state due to the engagement of the stopper 86. In other words, the maintenance component driven by the power transmitted from the power transmission mechanism 60 may be only one of the lock lever 45 and the wiper 40. Also in this case, one of the lock lever 45 and the wiper 40 is prevented from being operated when the electric motor 27 is driven for operating other devices while cleaning is not performed. For example, the structure may also be such that the lock lever 45 is omitted and only the wiper 40 is operated by the power transmission mechanism 60. Alternatively, the structure may also be such that the wiper is integrated with the cap 100 by providing a wiping member on the main body (cap holder) of the cap 100 and only the lock lever 45 is operated by the power transmission mechanism 60. Thus, also when only one of the lock lever 45 and the wiper 40 is operated by the power from the power transmission mechanism 60, the lock lever 45 is prevented from moving toward the lock position or the wiper 40 is prevented from moving toward the wiping position while other devices are being operated. The structure of the lock member is not limited to the lever structure in which the lock member reciprocally pivots (rotates) between the standby position and the lock position, and may also be a sliding structure in which the lock lever slides vertically.

Third Modification

The maintenance components operated by the power of the rotational drive source are not limited to the lock lever 45 and the wiper 40. For example, the cap may also be a maintenance component and be operated by the power transmitted by the power transmission mechanism from the electric motor 27 that functions as the rotational drive source. In this case, the lock lever 45 may be omitted and the maintenance components may be the cap and the wiper. Alternatively, the maintenance components may be the lock lever and the cap. In addition, the maintenance components operated by the power transmission mechanism may also be the lock lever, the wiper, and the cap. When the maintenance components are the wiper and the cap, the structure discussed in JP-A-2005-144690 is applied and a stopper is provided on a movable body (a rotating body, a cam body) included in the power transmission mechanism such that the stopper can be retained. In addition, other maintenance components may also be added to the above-mentioned three components so that four or more maintenance components are operated by the power transmission mechanism.

Fourth Modification

The movable body retained by the retaining unit may also be the maintenance component itself (for example, the lock lever 45 or the wiper 40). In the case in which the lock lever 45 is retained, an engaging portion (for example, the projection 47, an engaging recess, or an engaging hole) is provided on the lock lever 45 and the stopper engages with the engaging portion of the lock lever 45. In the case in which the wiper 40 is retained, an engaging portion (for example, an engaging recess or an engaging hole) is provided on the wiper 40 and the stopper engages with the engaging portion of the wiper 40. In this case, the stopper is preferably provided for each of a plurality of maintenance components at a corresponding position. For example, in addition to the stopper 86 for the wiper 40, a stopper that projects from the protruding portion 80*a* of the slider 80 may be provided at a position corresponding to the lock lever 45. The stopper engages with the projection 47 of the lock lever 45 at a retaining position, so that the lock lever 45 cannot move from the standby position to the lock position.

Fifth Modification

In the above-described embodiment, the cylindrical cam 67, which is one of the components of the friction clutch gear mechanism, is used as the cam body. However, other components may also be used as the cam body. For example, a rotating body or a gear that can rotate together with the cylindrical cam of the friction clutch gear mechanism may be provided on the same axis as the cylindrical cam. In this case, the cam portions may be formed in the rotating body or in a rotating body that is operably connected to the gear with another gear interposed therebetween. In addition, the engaging portion may also be formed in the above-described rotating bodies.

Sixth Modification

In the above-described embodiment, the cylindrical cam 67, which is a single movable body (rotating body), functions as both the movable body (rotating body) having the engaging portion (retaining hole 71) to which the stopper is engaged and the cam body for moving the lock lever and the wiper between the standby positions and the operating positions thereof. However, the invention is not limited to this. For example, the movable body having the engaging portion (retaining hole 71) to which the stopper is engaged and the cam body having the cam portions (the protrusion 75 and cam groove 70) to which the cam followers (the projection 47 and the guide pin 43) of the lock lever and the wiper are engaged may be separately provided. In such a case, freedom in the arrangement positions of the stopper 86, the lock lever 45, and the guide pin 43 is increased, and accordingly the layout freedom of the components of the maintenance device can be increased.

Seventh Modification

In the above-described embodiment, the engaging portion (retaining hole 71) is formed in the rotating body (cylindrical cam 67) included in the clutch unit (friction clutch gear mechanism), so that the rotating body of the clutch unit serves also as the movable body having the engaging portion (retaining hole 71) to which the stopper is engaged. However, the invention is not limited to this. For example, the movable body (engaging component) having the engaging portion (retaining hole 71) and the rotating body of the clutch unit may be provided separately. In such a case, it is not necessary to dispose the clutch unit at the position where the stopper can be engaged, so that freedom in the arrangement positions of the clutch unit and the stopper is increased and the layout freedom of the components of the maintenance device can be increased accordingly.

Eighth Modification

In the above-described embodiment, the cam portion is formed in the rotating body included in the clutch unit (friction clutch gear mechanism), so that the rotating body of the clutch unit serves also as the cam body (cylindrical cam 67) for moving the wiper between the standby position and the wiping position. However, the invention is not limited to this. For example, the rotating body of the clutch unit and the cam body having the cam portions (the protrusion 75 and the cam groove 70) that respectively engage with the cam followers (the projection 47 and the guide pin 43) of the lock lever and the wiper may also be provided separately. In such a case, freedom in the arrangement positions of the clutch unit and the cam body is increased and the layout freedom of the components of the maintenance device can be increased accordingly.

Ninth Modification

In the above-described embodiment, the engaging portion to which the stopper is engaged is formed as a retaining hole (recess). However, the engaging portion may also be a through hole. In other words, the engaging portion may be any type of cutout, including a recess, a through hole, etc. In addition, the engaging portion may also be a protrusion provided on the movable body and a cutout (a recess, a through hole, etc.) that can engage with the protrusion may be formed at the end of the stopper.

Tenth Modification

In the above-described embodiment, the invention is applied to the maintenance device including an elevator unit of the slider driving type, with which the slider 80 is slid in association with the movement of the carriage, as the cap-moving unit. However, the invention may also be applied to a maintenance device having a linear moving unit that linearly moves the cap in the vertical direction. In the case in which the elevator mechanism for moving a support body of the cap in the vertical direction is of a linear type, a stopper is provided on the support body of the cap 100 (support holder for holding the cap such that the cap is urged upward) and is inserted into a retaining hole formed in the cylindrical cam when the support body is moved downward. In an example of such a structure, a stopper that can move parallel to the moving direction of the carriage in a horizontal direction is provided at the bottom of the support body, and the stopper is urged by a spring in a direction such that the stopper is removed (pulled out) from the retaining hole 71. In addition, the support body has a lever that provides a lever function for pushing the stopper in the horizontal direction toward the retaining hole against the urging force of the spring when pushed from below, and an operating portion of the lever is disposed at the bottom of the support body. When the support body is moved downward, the operating portion comes into contact with a contact member arranged on the bottom surface of the frame, and the stopper is pushed in the horizontal direction against the urging force of the spring due to the lever effect. Accordingly, the stopper is inserted into the retaining hole. The rotational drive source of the linear elevator unit is preferably used in common with the wiper.

Eleventh Modification

In the above-described embodiment, a moving mechanism for reciprocating the cap (the slider 80, the guide holes 58 and 59, the coil spring 115, etc.) is used for structuring the retaining mechanism. More specifically, the retaining mechanism is obtained by providing the stopper 86 on the slider 80. However, the invention is not limited to this. The retaining mechanism using the stopper includes a lever that engages with a part of the carriage (including the liquid ejection head) immediately before the carriage reaches the cleaning position, and the stopper is moved between the retaining position and the released position in response to the operation of the lever. In addition, the retaining mechanism includes a spring (urging member) for applying an urging force to the lever in a direction such that the stopper is moved to the retaining position. The carriage comes into contact with an engaging portion of the lever and pushes the lever while moving toward the cleaning position, and accordingly the lever is rotated by the pushing force and the stopper is moved to the retaining position. When the carriage moves away from the cleaning position, the lever is rotated in the returning direction due to the urging force applied by the lever, and accordingly the stopper is moved to the released position. In the structure in which the wiping member is formed integrally with the support body (cap holder) that supports the cap, the power transmission mechanism according to the embodiment of the invention may be used as the cap-moving unit and the above-described retaining mechanism that has the stopper operated in association with the movement of the carriage may be additionally provided.

Twelfth Modification

In the above-described embodiment, the paper feed motor is used as the rotational drive source, and the rotational drive source is used in common by the wiping device, which is one of the maintenance components, the driving devices for the paper feeding system, the paper conveying system, and the paper ejecting system, and the suction pump. However, the invention is not limited to this. For example, the structure may also be such that the rotational drive source is used in common by the carriage lock device, the wiping device, and at least one of the driving devices for the paper feeding system, the paper conveying system, and the paper ejecting system, and a rotational drive source of the suction pump is separately provided.

Thirteenth Modification

When there is no risk that the cylindrical cam 67 will receive an excessive load that causes the friction clutch 68 to slip while the wiper 40 is moved vertically, the tooth portion 72 may be omitted. Also in this structure, the cylindrical gear 66 and the cylindrical cam 67 rotate together due to the frictional engagement of the friction clutch 68 when the lock lever 45 and the wiper 40 are moved vertically. Accordingly, the lock lever 45 and the wiper 40 can be reliably moved upward or downward.

Fourteenth Modification

In the above-described embodiment, the cam body is the rotating body (the cylindrical cam 67) that is rotated by the power from the rotational drive source. However, the cam body is not limited to the rotating body. For example, the cam body may be a pivoting body including a lever having a predetermined shape, such as a sector shape and an L-shape, and be pivoted by the power from the rotational drive source.

Fifteenth Modification

In the above-described embodiment, the suction discharge unit is used as the unit for ejecting liquid from the liquid ejection head, and the suction pump is provided as a component of the suction discharge unit. However, the liquid may also be ejected using methods other than suction. For example, instead of the suction pump, a pressure-type liquid discharge unit which pressurizes the liquid chambers in the liquid ejection head using a pressurizing member so that the liquid is discharged through the nozzles may also be used. In such a case, the suction pump is omitted from the maintenance device.

Sixteenth Modification

The clutch unit is not limited to the friction clutch gear unit which transmits power through the frictional engagement of the contact surfaces while a load applied to a component on the downstream side is small and which causes the contact surfaces to slip so that the power is not transmitted when a large load is applied to the component on the downstream side. A clutch unit having a mechanism that transmits power without using friction may also be applied. In such a clutch unit, power is transmitted through a certain mechanical engagement while a load applied to a component on the downstream side is small, and the mechanical engagement is canceled so that the power is not transmitted when a large load is applied to the component on the downstream side. An example of such an engagement mechanism includes a first engaging member that is urged by an elastic body, such as a spring, so as to project from an end surface of a gear included in the clutch unit, a second engaging member provided on an end face of a rotating body in the clutch unit so as to be engageable with the first engaging member, and an engagement-canceling unit (for example, a curve provided at the engagement position) that disengages the first and second engaging members against the urging force applied by the elastic body when a load higher than a predetermined value is applied to the rotating body. In such a clutch unit, the engaging surfaces between the first and second engaging members serve as clutch surfaces.

Seventeenth Modification

In the above-described embodiment, the movement of the cylindrical cam 67 that functions as the movable body (the rotating body and the cam body) having the engaging portion is rotation. However, the movement of the movable body is not limited to this. For example, the movable body may also change the position thereof by moving along a linear path or a curved path. An example of a movable body that moves along a linear path is a rack included in a rack-and-pinion mechanism. Another example of a movable body that moves along a linear path has a shaft (cam follower) engaged with a cam groove formed in a rotating body. In addition, an example of a movable body that moves along a curved path is connected to a shaft provided on an end face of a rotating body and is guided along an arc-shaped guiding path in association with the rotation of the rotating body, thereby moving along an arc-shaped trajectory. The engaging portion may also be provided on the movable body that moves in the above-described manner such that the engaging portion can be engaged with the stopper.

Eighteenth Modification

In the above-described embodiment, the power transmission mechanism 60 including the clutch unit is formed integrally with the frame 51 of the maintenance unit 50. However, the clutch unit included in the power transmission mechanism 60 may also be assembled to a component other than the frame 51, for example, to a base of the recording apparatus. In this case, the maintenance unit including portions of the power transmission mechanism excluding the clutch unit and portions of the power transmission mechanism including the clutch unit assembled to the base form the maintenance device.

Nineteenth Modification

In the above-described embodiment, the inkjet recording apparatus 10 is explained as an example of the liquid-ejecting apparatus. However, the invention is not limited to this. For example, the invention may also be applied to liquid-ejecting apparatuses that eject liquid other than ink (including liquid body in which functional particles are dissipated). For example, the invention may be applied to liquid-ejecting apparatuses that eject liquid bodies in which materials, such as electrode materials and color materials used for manufacturing liquid crystal display, electroluminescence (EL) display, surface emitting display, etc., are dispersed or dissolved, liquid-ejecting apparatuses that eject living organic material for manufacturing biochips, and liquid-ejecting apparatuses that are used as precise pipettes for ejecting liquid used as a sample. The maintenance device according to the embodiment of the invention which includes maintenance components for performing maintenance of the liquid ejection head may be applied to any of the above-mentioned liquid-ejecting apparatuses.

The technical idea of the above-described embodiment and modifications will be described below.

(1) In the maintenance device for the liquid-ejecting apparatus, the moving unit may include the slider (80) that slides by being pushed by the carriage or the liquid ejection head when the carriage moves toward the cleaning position; guiding members (58, 59, and 82 to 85) that guide the slider upward when the slider slides by being pushed by the carriage or the liquid ejection head; and an urging member (115) that urges the slider in a direction such that the slider is guided downward by the guiding members. The cap is provided on the slider, and the stopper, which moves in association with the vertical movement of the cap, is provided on the slider.

Since the cap moves vertically in association with the movement of the carriage, the structure of the moving unit can be simplified and accordingly the structure of the maintenance device can be simplified.

(2) In the maintenance device, the cam body, which functions as the movable body, may be disposed so as to face the slider when the cap is moved downward to the standby position. In addition, the stopper may be provided on the slider at a position where the stopper faces the cam body. Accordingly, the structure in which the stopper is provided on the slider for moving the cap in the vertical direction and the stopper is caused to engage with the cam body can be relatively easily obtained.

(3) In the maintenance device, the clutch unit may be disposed so as to face the slider when the cap is moved downward to the standby position, and the stopper may be provided on the slider at a position where the stopper faces the clutch unit. Accordingly, the structure in which the stopper is provided on the slider for moving the cap in the vertical direction and the stopper is caused to engage with a component (rotating body) on the downstream of the clutch surfaces of the clutch in the power-transmitting direction can be easily obtained. The engaging portion is provided on the rotating body.

(4) In the maintenance device, the wiper that functions as the maintenance component may be disposed so as to face the slider when the cap is moved downward to the standby position. In addition, the clutch unit may be disposed so as to face the slider with the wiper disposed therebetween. The rotating body, which is the component on the downstream of the clutch surfaces of the clutch, is provided with the engaging portion and the cam portion, and thus the rotating body also functions as the cam body. Accordingly, since the rotating body, which is a component of the clutch unit, functions as the cam body, the number of components can be reduced. In addition, since the wiper is disposed so as to face the rotating body, the cam portion and the cam follower of the wiper can be easily structured. The maintenance device preferably has a guide portion (53) that supports the wiper in such a manner that the wiper can move, and the guide portion preferably has a cutout (53*b*) through which the stopper can be inserted. Accordingly, the stopper can be engaged with the engaging portion on the rotating body (cam body) that is positioned behind the guide portion of the wiper without being impeded by the guide portion.

(5) In the maintenance device for the liquid-ejecting apparatus, the moving unit may include a support body on which the cap is mounted and an elevator mechanism for moving the support body in the vertical direction. The stopper is provided on the support body, and the movable body to be restrained by the stopper is disposed so as to face the support body when the cap is moved downward to the standby position. The movable body has an engaging portion at a position where the engaging portion faces the stopper when the stopper is at the retaining position.

Accordingly, when the support body is moved downward by the elevator mechanism and the cap is moved to the standby position, the stopper moves downward together with the support body and becomes engaged with the engaging portion provided on the movable body that is disposed so as to face the support body at the lowermost position. Since the stopper is provided on the support body and the elevator unit is used, the moving mechanism (retaining mechanism) of the stopper can be easily structured.

(6) In the maintenance device for the liquid-ejecting apparatus, the clutch unit may be engaged to allow power transmission while the load applied to a component on the downstream side in the power-transmitting direction is equal to or less than a predetermined value, and be disengaged so that power cannot be transmitted when the load exceeds the predetermined value.

(7) In the maintenance device for the liquid-ejecting apparatus, the stopper may move in association with the movement of the carriage such that the stopper is disposed at the retaining position when the carriage is not at the cleaning position and is disposed at the released position when the carriage is at the cleaning position. In addition, an engagement-canceling unit (74) may be provided which prevents the stopper from being engaged with the movable body and restricting the movement of the maintenance component from the operating position to the standby position when the stopper is at the retaining position and the maintenance component is not at the standby position. Accordingly, even after the carriage is moved away from the cleaning position, the maintenance component can be returned to the standby position from the operating position.

(8) In the maintenance device for the liquid-ejecting apparatus, the stopper may move in association with the movement of the cap such that the stopper is disposed at the retaining position when the cap is at the standby position and is disposed at the released position when the cap is at the sealing position. In addition, an engagement-canceling unit (74) may be provided which prevents the stopper from being engaged with the movable body and restricting the movement of the maintenance component from the operating position to the standby position when the stopper is at the retaining position and the maintenance component is not at the standby position. Accordingly, even after the cap is moved from the sealing position to the standby position, the maintenance component can be returned to the standby position from the operating position.

(9) In the maintenance device, the movable body (67) may be the cam body that reciprocates within a finite range, and the converting unit may cause the maintenance component to move upward when the cam body rotates in one direction within the finite range and downward when the cam body rotates in the other direction within the finite range. The engagement-canceling unit has a movement-allowing surface (74) that allows the stopper at the retaining position to move relative to the cam body while being in contact with the movement-allowing surface when the cam body moves a second driving position (second rotational position) for placing the maintenance component at the operating position to the first driving position (first rotational position) for placing the maintenance component at the standby position. The movement-allowing surface is provided on at least one of the cam body and the stopper. In addition, the movement-allowing surface is not limited to an inclined surface, and may also be a curved surface or a flat surface. Since the stopper at the retaining position can be moved relative to the movement-allowing surface, the cam body can move from the second driving position to the first driving position. Therefore, even after the cap is moved to the standby position, the maintenance component can be returned to the standby position from the operating position.

The entire disclosure of Japanese Patent Application Nos: 2005-285497, filed Sep. 29, 2005 and No. 2005-285498, filed Sep. 29, 2005 are expressly incorporated by reference herein.

What is claimed is:

1. A maintenance device installed in a liquid-ejecting apparatus including a movable carriage that has a liquid ejection head, the maintenance device performing maintenance of the liquid ejection head and comprising:

at least one maintenance component that reciprocates between an operating position at which the maintenance component engages with the carriage or the liquid ejection head and a standby position at which the maintenance component is disengaged from either of the carriage and the liquid ejection head;

a power transmission mechanism that transmits power input from a rotational drive source to output power for reciprocating the maintenance component between the operating position and the standby position, the power transmission mechanism having a clutch unit on a power transmission path of the power transmission mechanism; and a retaining mechanism including a stopper that moves in association with the movement of the carriage such that the stopper engages with at least one movable body provided on the power transmission path between the maintenance component and clutch surfaces of the clutch unit when the carriage is separated from a cleaning position, and such that the stopper is disengaged from the movable body when the carriage is at the cleaning position.

2. The maintenance device according to claim 1, wherein the maintenance device includes:

a cap that seals a nozzle surface of the liquid ejection head, the cap functioning as a maintenance component other than the maintenance component operated by the power transmitted through the power transmission mechanism; and a moving unit that reciprocates the cap between a standby position and a sealing position, the moving unit including a slider that engages with the carriage or the liquid ejection heat to slide therewith when the carriage moves to the cleaning position; a guiding unit that guides the slider in a vertical direction when the slider slides; and an urging unit for urging the slider downward, wherein the cap is mounted on the slider, and wherein the restraining member includes the moving unit and the stopper is provided on the slider.

3. The maintenance device according to claim 2, further comprising a suction pump for applying a negative pressure to the cap, the suction pump being driven by power input to the power transmission mechanism.

4. The maintenance device according to claim 1, wherein the power transmission mechanism includes a cam body having a cam portion that is engageable with a cam follower provided on the maintenance component, wherein the cam portion and the cam follower are included in a converting unit that converts a movement of the cam body into the reciprocating movement of the maintenance component, and wherein the movable body with which the stopper engages is the cam body, and the cam body has an engaging portion that engages with the stopper.

5. The maintenance device according to claim 4, wherein the at least one maintenance component includes a lock member that engages with the carriage to position the carriage at the cleaning position, the lock member reciprocating between a lock position where the lock member engage with the carriage and a standby position where the lock member is disengaged from the carriage, wherein the cam body reciprocates within a finite range, and wherein the converting unit covers the movement of the cam body in one direction within the finite range into a singe reciprocation of the lock member in which the lock member moves from the standby position to the lock position and then returns to the standby position.

6. The maintenance device according to claim 4, wherein the at least one maintenance component includes a wiper that wipes a nozzle surface of the liquid ejection head, the wiper reciprocating between a wiping position and a standby position, wherein the cam body reciprocates within a finite range, and wherein the converting unit covers the movement of the cam body in one direction within the finite range into a movement of the wiper from the standby position to the wiping position and converts the movement of the cam body in the other direction within the finite range into a movement of the wiper from the wiping position to the standby position.

7. The maintenance device according to claim 4, wherein the at least one maintenance component includes a first maintenance component and a second maintenance component that perform different maintenance operations, wherein the power transmission mechanism includes a cam body having a first cam portion that engages with a first cam follower provided on the first maintenance component and a second cam portion that engages with a second cam follower provided on the second maintenance component, the cam body being positioned downstream of the clutch surfaces in a power-transmitting direction, and wherein the converting unit includes a first converting member that includes the first cam portion and the first cam follower and converts the movement of the cam body into a reciprocating movement of the first maintenance component, and a second converting member that includes the second cam portion and the second cam follower and converts the movement of the cam body into a reciprocating movement of the second maintenance component.

8. The maintenance device according to claim 7, wherein the cam body reciprocally rotates within a finite range, and wherein the first maintenance component moves upward and downward to perform a single reciprocation when the cam body rotates in one direction within the finite range, and the second maintenance component moves upward when the cam body rotates in one direction within the finite range and downward when the cam body rotates in the other direction within the finite range.

9. The maintenance device according to claim 8, wherein the first maintenance component is a lock member that engages with the carriage to position the carriage at the cleaning position, the lock member reciprocating between a lock position where the lock member engage with the carriage and a standby position where the lock member is disengaged from the carriage, and wherein the second maintenance component is a wiper that wipes a nozzle surface of the liquid ejection head, the wiper reciprocating between a wiping position and a standby position.

10. The maintenance device according to claim 4, further comprising:

a cap that seals a nozzle surface of the liquid ejection head, the cap functioning as the maintenance component operated by the power transmitted through the power transmission mechanism or as another maintenance component that is operated by a moving unit other than the power transmission mechanism; and a suction pump for applying a negative pressure to the cap, the suction pump being operated by the power input to the power transmission mechanism, wherein the cam body reciprocates within a finite range, and wherein the power input to the suction pump is divided at a position upstream of the clutch surfaces of the clutch unit in a power-transmitting direction in the power transmission mechanism.

11. The maintenance device according to claim 1, wherein the clutch unit includes a gear and a rotating body that are coaxially arranged to be rotatable relative to each other and that come into contact with each other and separate from each other at the clutch surfaces, the rotating body being positioned downstream of the clutch surfaces in a power-transmitting direction, and wherein the movable body with which the stopper engages is the rotating body, and the rotating body has an engaging portion that engages with the stopper.

12. The maintenance device according to claim 11, wherein the rotating body included in the clutch unit has a cam portion that is engageable with a cam follower provided on the maintenance component, and wherein the cam portion and the cam follower are included in a converting unit that converts a movement of the rotating body into the reciprocating movement of the maintenance component.

13. The maintenance device according to claim 1, wherein the at least one maintenance component includes a lock member that engages with the carriage to position the carriage at the cleaning position, the lock member reciprocating between a lock position where the lock member engage with the carriage and a standby position where the lock member is disengaged from the carriage.

14. The maintenance device according to claim 1, wherein the at least one maintenance component includes a wiper that wipes a nozzle surface of the liquid ejection head, the wiper reciprocating between a wiping position and a standby position.

15. The maintenance device according to claim 1, wherein the clutch unit is a friction clutch unit including a gear, a rotating body arranged coaxially with the gear so as to be rotatable relative to the gear, and a friction clutch that applies a combining frictional force to contact surfaces of the gear and the rotating body, the combining frictional force allowing the gear and the rotating body to rotate together.

16. The maintenance device according to claim 15, wherein the rotating body has a tooth portion that meshes with a drive gear that meshes with the gear included in the frictional clutch unit and that is positioned upstream of the gear in the power-transmitting direction, the tooth portion being capable of meshing with the drive gear when the rotating body is in a rotational range corresponding to an intermediate range of a moving stroke of the maintenance component.

17. A liquid-ejecting apparatus comprising:

a carriage having a liquid ejection head; and a maintenance device according to claim 1, the stopper included in the maintenance device operating in association with the movement of the carriage.

18. The liquid-ejecting apparatus according to claim 17, wherein the liquid-ejecting apparatus includes:

a conveyance drive unit that conveys a medium on which the liquid ejected from the liquid ejection head lands; and a rotational drive source that applies power for conveying the medium to the conveyance drive unit, the rotational drive source functioning as a rotational drive source that applies power to the maintenance device.

19. A maintenance device installed in a liquid-ejecting apparatus including a movable carriage that has a liquid ejection head, the maintenance device performing maintenance of the liquid ejection head and comprising:

a cap that seals a nozzle surface of the liquid ejection head;

a moving unit that reciprocates the cap between the standby position and the sealing position;

at least one maintenance component that reciprocates between an operating position at which the maintenance component engages with the carriage or the liquid ejection head and a standby position at which the maintenance component is disengaged from the carriage and the liquid ejection head;

a power transmission mechanism that transmits power input from a rotational drive source to output power for reciprocating the maintenance component between the operating position and the standby position, the power transmission mechanism having a clutch unit on a power transmission path of the power transmission mechanism; and a retaining mechanism including a stopper that moves in association with the movement of the cap such that the stopper engages with at least one movable body provided on the power transmission path between the maintenance component and clutch surfaces of the clutch unit when the cap is at the standby position, and such that the stopper is disengaged from the movable body when the cap is at the sealing position.

20. A liquid-ejecting apparatus comprising:

a liquid ejection head; and a maintenance device according to claim 19, the stopper included in the maintenance device operating in association with the movement of the cap.

* * * * *